US005635968A

United States Patent [19]

Bhaskar et al.

[11] Patent Number: 5,635,968

[45] Date of Patent: Jun. 3, 1997

[54] THERMAL INKJET PRINTER PRINTHEAD WITH OFFSET HEATER RESISTORS

[75] Inventors: Eldurkar V. Bhaskar; Marzio Leban; Ulrich E. Hess; Niels J. Nielsen; Kenneth E. Trueba; Ellen Tappon, all of Corvallis, Oreg.; Duane A. Fasen, Loveland, Colo.

[73] Assignee: Hewlett-Packard Company, Palo Alto, Calif.

[21] Appl. No.: 236,915

[22] Filed: Apr. 29, 1994

[51] Int. Cl.[6] ..... B41J 2/05

[52] U.S. Cl. ..... 347/59

[58] Field of Search ..... 347/59, 50, 12, 347/6, 57, 58, 40

[56] References Cited

U.S. PATENT DOCUMENTS

| | | | |
|---|---|---|---|
| 3,852,563 | 12/1974 | Bohorquez et al. | 219/216 |
| 4,429,321 | 1/1984 | Matsumoto | 346/140 |
| 4,458,256 | 7/1984 | Shirato et al. | 347/55 |
| 4,513,298 | 4/1985 | Scheu | 346/140 |
| 4,535,343 | 8/1985 | Wright et al. | 346/140 |
| 4,596,994 | 6/1986 | Matsuda et al. | 346/140 |
| 4,695,853 | 9/1987 | Hackleman et al. | 346/140 |
| 4,716,421 | 12/1987 | Ozawa et al. | 346/140 |
| 4,719,477 | 1/1988 | Hess | 346/140 |
| 4,803,500 | 2/1989 | Milbrandt | 346/140 |
| 4,812,859 | 3/1989 | Chan et al. | 346/140 |
| 4,862,197 | 8/1989 | Stoffel | 346/140 |
| 4,872,027 | 10/1989 | Buskirk et al. | 347/19 |
| 4,899,180 | 2/1990 | Elhatem et al. | 346/140 |
| 4,930,915 | 6/1990 | Kikuchi et al. | 400/175 |
| 4,961,103 | 10/1990 | Saitoh et al. | 357/59 |
| 4,963,897 | 10/1990 | Kattner | 346/140 |
| 5,103,246 | 4/1992 | Dunn | 346/140 |
| 5,206,668 | 4/1993 | Lo et al. | 347/6 |
| 5,235,351 | 8/1993 | Koizumi | 346/140 |
| 5,278,584 | 1/1994 | Keefe et al. | 346/140 |
| 5,315,472 | 5/1994 | Fong et al. | 361/212 |
| 5,363,134 | 11/1994 | Barbehenn et al. | 347/49 |

FOREIGN PATENT DOCUMENTS

| | | |
|---|---|---|
| 0401440A1 | 6/1989 | European Pat. Off. . |
| 0378439A3 | 1/1990 | European Pat. Off. . |

OTHER PUBLICATIONS

HP Journal Oct. 1988, W. Buskirk et al, Development of a High-Resolution Thermal InkJet Printhead, pp. 55–62.

HP Journal Oct. 1988, J. Paul Harmon et al, Integrating the Printhead into the HP DeskJet Printer, pp. 62–66.

HP Journal Feb. 1994, J. Stephen Aden et al, The Third-Generation HP Thermal InkJet Printhead, pp. 41–45.

HP Journal May 1985, G. Siewell et al, The ThinkJet Orifice Plate: A Part With Many Functions, pp. 33–37.

HP Journal May 1985, E. Bhaskar et al, Development of the Thin-Film Structure for the ThinkJet Printhead, pp. 27–32.

*Primary Examiner*—Benjamin R. Fuller
*Assistant Examiner*—Craig A. Hallacher
*Attorney, Agent, or Firm*—Raymond A. Jenski

[57] ABSTRACT

A printhead includes a substrate with an ink feed aperture extending from a first surface to a second surface and a plurality of heater resistors disposed on it. Primitive groupings of the resistors are coupled to associated group power sources. An ink barrier layer is deposited on the substrate to create ink firing chambers for each resistor. One wall of the ink barrier has a constricted opening through which ink is supplied from the ink feed aperture. A plurality of transistors are disposed in the substrate with each transistor output coupled to an associated one of the resistors and each input coupled to one of a plurality of addressing signal lines. The number of addressing signal lines is equal to the number of resistors in a primitive grouping.

14 Claims, 14 Drawing Sheets

THERMAL INKJET PRINTER PRINTHEAD WITH OFFSET HEATER RESISTORS

CROSS REFERENCE TO RELATED PATENTS AND APPLICATIONS

This application is related to the subject matter disclosed in the following U.S. Patents and U.S. Patent applications, all of which are assigned to the assignee of the present invention: U.S. Pat. Nos. 5,083,137; 5,122,812; 5,159,353; and 5,206,668. U.S. patent application Ser. Nos. 07/886,641 titled "Integrated Circuit Printhead for an Ink Jet Printer Including an Integrated Identification Circuit" by Barbehenn et al; 07/958,833 titled "Printhead With Reduced Inteconnections to a Printer" by Saunders et al; 07/734,725 titled "Ground Ring/Spark Gap ESD Protection of TAB Circuits" by Fong et al; 08/118,104 titled "Bipolar Integrated Ink Jet Printhead Driver" by Hess et al; 08/055,617 titled "Reliable Contact Pad Arrangement on Plastic Print Cartridge" by Reid et al; 08/009,151 titled "Fabrication of Ink Fill Slots in Thermal Ink-Jet Printheads Utilizing Chemical Micromachining" by Baughman et al; and 08/235,610 titled "Edge Feed Ink Delivery Thermal Inkjet Printhead Structure and Method of Fabrication" by Keefe et al and filed on the same date as the patent invention.

BACKGROUND OF THE INVENTION

The present invention generally relates to a printhead for a thermal inkjet printer print cartridge and more particularly to a thermal inkjet cartridge printhead and associated interconnect and method for making the same which involves the integration of driver and multiplexing transistor circuitry with thin film technology and ink flow control to yield a printhead having improved print quality, print speed, and lower cost.

A substantial demand exists for printing system of high efficiency and resolution. To satisfy this demand, thermal inkjet print cartridges have been developed which print in a rapid and efficient manner. These cartridges include an ink reservoir in fluid communication with a multilayer printhead substrate having a plurality of resistors disposed in at least one of the layers. Selective electrical activation of the resistors causes a rapid boiling of the ink proximate to the activated resistors and expulsion of the ink from orifices in the printhead of the cartridge. Known representative thermal inkjet systems are discussed in U.S. Pat. Nos. 4,500,895; 4,514,298; and 4,794,409; the Hewlett-Packard Journal. Vol. 36, No. 5 (May 1985); and the Hewlett-Packard Journal, Vol. 39, No. 4 (August 1988).

In recent years, research has been conducted in order to increase the degree of print resolution, throughput, and quality of thermal inkjet printing systems. Print resolution depends on the number of ink-ejecting orifices and heating resistors formed on the cartridge printhead substrate. Modern circuit fabrication techniques allow the placement of substantial numbers of resistors on a single printhead substrate. However, the number of resistors applied to the substrate is limited by the conductive components used to electrically connect the cartridge to external driver circuitry in the printer unit. Specifically, an increasingly large number of resistors requires a correspondingly large number of interconnection pads, leads, and the like. This increase in components and interconnect causes greater manufacturing/production costs, and increases the probability that defects will occur during the manufacturing process.

In order to solve this problem, thermal inkjet printheads have been developed which incorporate pulse driver circuitry (e.g. metal oxide semiconductor field effect (MOSFET) transistors) directly on the printhead substrate with the resistors. This development is described in U.S. Pat. Nos. 4,719,477; 4,532,530; and 4,947,192. The incorporation of driver circuitry on the printhead substrate in this manner reduces the number of interconnect components needed to electrically connect the cartridge to the printer unit. This results in an improved degree of production and operating efficiency.

To produce high-efficiency, integrated printing systems as described above, significant research has been conducted in order to develop improved MOSFET transistor structures and methods for integrating the same into thermal inkjet printing units. Currently, MOSFET devices are manufactured using a substantial number of conventional masking/etching steps. However, it is always desirable in the production of MOSFET devices and thermal inkjet printing systems to reduce the number of necessary materials and manufacturing steps. This results in lower production costs and greater manufacturing efficiency. An integration of driver components and printing resistors onto a common substrate would result in a need for specialized, multi-layer connective circuitry so that the driver transistors can communicate with the resistors and other portions of the printing system. Typically, this connective circuitry involves a plurality of separate conductive layers, each being formed using conventional circuit fabrication techniques. However, this procedure again results in increased production costs and diminished manufacturing efficiency.

To create the resistors, conventionally, an electrically conducting layer is positioned on selected portions of the layer of resistive material in order to form covered sections of the resistive material and uncovered sections thereof. The uncovered sections ultimately function as heating resistors in the printhead. The covered sections are used to form continuous conductive links between the electrical contact regions of the transistors and other components in the printing system (e.g. the heating resistors). Thus, the layer of resistive material performs dual functions: as heating resistors in the system, and as direct conductive pathways to the drive transistors. This substantially eliminates the need to use multiple layers for carrying out these functions alone.

A selected portion of protective material is then applied to the covered and uncovered sections of resistive material. Thereafter, an orifice plate having a plurality of openings through the plate is positioned on the protective material. Beneath the openings, a section of the protective material which was removed forms ink firing cavities or chambers. Positioned at the bottom surface of each chamber is one of the heater resistors. The electrical activation of each resistor causes the resistor to rapidly heat and vaporize a portion of the ink in the cavity. The rapidly formed (nucleated) ink bubble ejects a droplet of ink from the orifice associated with the activated resistor and ink firing cavity.

Once the heater resistors have been placed closer together, the orifices (printhead nozzles) must also be placed more closely together to realize higher quality print. By placing nozzles closer together, the print quality can be improved. By placing more nozzles on the print head, the width of the printing swath is increased. However, adding resistors and nozzles requires adding associated power and control interconnections. These interconnections are conventionally flexible wires or equivalent conductors that electrically connect the transistor drivers on the printhead to printhead interface circuitry in the printer. They may be contained in a ribbon cable that connects on one end to control circuitry within the printer and on the other end to driver circuitry on the printhead. More heater resistors spaced closer together also creates a greater likelihood of crosstalk and increased difficulty in supplying ink to each firing chamber quickly.

Interconnections are a major source of cost in printer design, and adding them to increase the number of heater resistors increases the cost and reduces the reliability of the printer. Thus, as the number of drivers on a printhead has increased over the years, there have been attempts to reduce the number of interconnections per driver. A matrix approach offers an improvement over the direct drive approach, yet as previously realized a matrix approach has its drawbacks. The number of interconnections with a simple matrix is still large and still results in an undesirable increase in the number of interconnections Another concern with inkjet printing is the sufficiency of ink flow to the paper or other print media. Print quality is also a function of ink flow through the printhead. Too little ink on the paper or other media to be printed upon produces faded and hard-to-read printed documents. In a worst case, no ink may be printed and the entire document is lost. This scenario may occur where a facsimile machine, out of ink, receives a transmission when unattended and attempts to print. Since the inkjet pen moves across the media even when no ink is being ejected, the facsimile machine mistakenly assumes that the transmission has successfully been received and acknowledges reception to the sender.

Ink flow from its storage space to the ink firing chamber has suffered, in previous printhead designs, from an inability to be rapidly supplied to the firing chambers. The manifold from the ink source inherently provides some restriction on ink flow to the firing chambers thereby reducing the speed of printhead operation as well as resulting in crosstalk.

To resolve these needs of increased printing speed and quality, reduced number of interconnections, and improved ink flow control, a modem design of thermal ink jet printer printhead is desirable.

SUMMARY OF THE INVENTION

A printhead apparatus and method for making a printhead for a thermal inkier printer which includes a substrate having an ink feed aperture extending from a first surface to a second surface of the substrate. A plurality of heater resistors, which are disposed in the substrate, are arranged in at least one column. A first number of the heater resistors in the at least one column are arranged into one of a second number of primitive groups of heater resistors. Each of this second number of primitive groups are coupled to an associated one of the second number of primitive group power sources. The first number of heater resistors in the one primitive group are arranged in at least two subgroups, each of the heater resistors are disposed apart from its nearest neighboring by a first distance in the direction parallel to the direction defined by the at least one column. Each heater resistor in a first subgroup of the at least two subgroups of heater resistors is further offset from each neighboring heater resistor in a direction perpendicular to the direction defined by the at least one column. An ink barrier layer is disposed on the first surface of the substrate and is arranged in association with the plurality of resistors such that at least one wall of an ink firing chamber is created around each of the heater resistors disposed within each ink firing chamber. This wall has a constricted opening through which ink is supplied to each ink firing chamber. A plurality of transistors are disposed in the substrate with each transistor electrically coupled at its output to an associated one of the plurality of heater resistors and electrically coupled at its input to one of a plurality of addressing signal lines. The plurality of addressing signal lines is equal in number to the first number of heater resistors in the one of the second number of primitive groups.

DETAILED DESCRIPTION OF THE PREFERRED EMBODIMENTS

The present invention encompasses a thermal inkjet cartridge 100 for a printer and a method for making same, which provides improved print quality, print speed, and reliability at low cost. The cartridge includes several components which are visible in FIG. 1. The body 101 of the cartridge (sometimes referred to the "pen body") is, in the preferred embodiment, a hollow plastic housing which contains one or more printing ink containment devices which are fluidically coupled to a device which rapidly heats small quantities of the ink beyond boiling and ejects the small quantity of ink displaced by an ink vapor bubble through a small orifice for deposition on a medium (not shown) as a printed element of a character or image to be placed on the medium. This ink routing and boiling device is commonly referred to as a printhead and is depicted as printhead 103 in FIG. 1. The printhead 103 is electrically coupled to the printer (not shown) via a circuit board, which in the preferred embodiment is a flexible circuit 105 having conductive traces and other elements disposed thereon. General construction and operation of thermal inkjet systems may be found in the Hewlett-Packard Journal, Vol. 36, No. 5 (May 1985) and the Hewlett-Packard Journal, Vol. 39, No. 4 (August 1988) and the Hewlett-Packard Journal, Vol. 45, No. 1 (February 1994).

Figure 2:
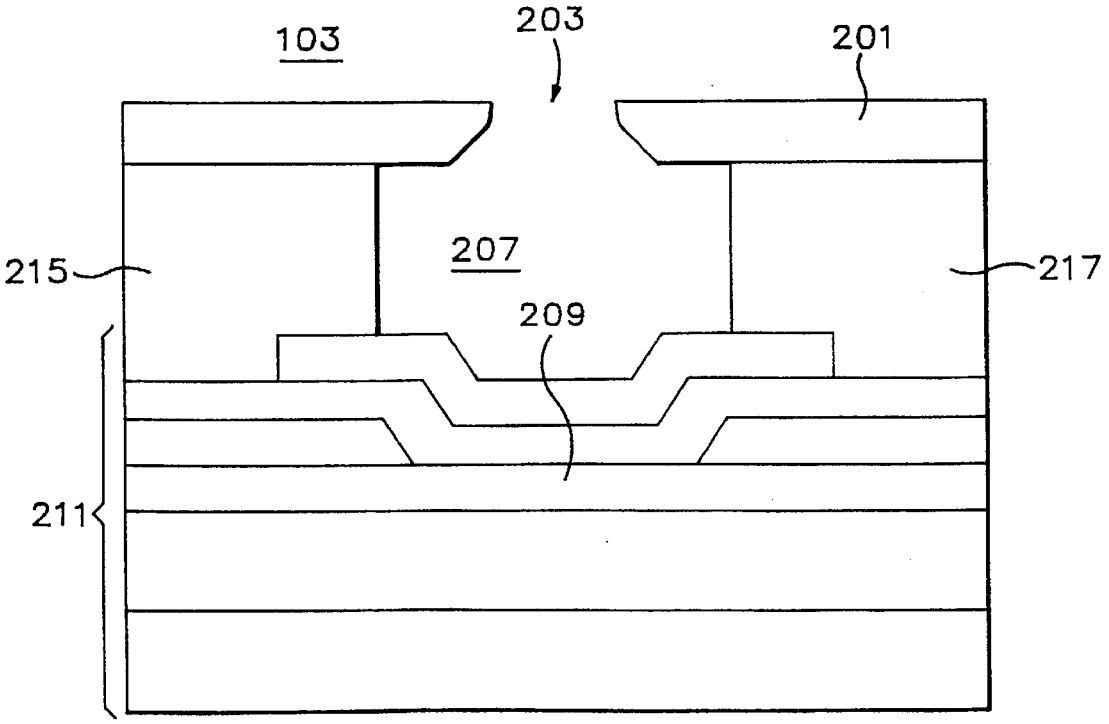
FIG. 2 is a cross sectional diagram of a firing cavity of a printhead which may employ the present invention.

The printhead 103 is shown in a cross sectional view of FIG. 2 in which it can be seen that the printhead is comprised of several individual layers of materials constructed and assembled to perform its function. An orifice plate 201 forms the outermost layer, the layer which is externally visible on the print cartridge and which is held in close proximity to the medium by the printer. In the preferred embodiment, the orifice plate 201 is constructed of gold plated nickel, through which one hundred four printing orifices (represented by the single orifice 203 in FIG. 2 and illustrating the general positioning of the orifice relative to other components of the printhead) extend from the external surface to an internal ink firing chamber 207. A plurality of heater resistors (represented by heater resistor 209 in FIG. 2) is created by the selective plating of resistive and conductive materials on the surface of a silicon wafer. An ink barrier layer is selectively deposited upon the surface of substrate 211 so that walls (215, 217) of the ink firing chamber are created. It will be seen, below, that these walls are arranged to form three sides of the chamber and a constricted opening on the fourth side. Ink (not shown) is introduced into the ink firing chamber 207 via the constricted opening and a selective electrical energization of the heater resistor produces a heat-generated vapor bubble at the ink chamber surface of the resistor 209. This rapidly formed bubble forces a droplet of ink to be ejected from the orifice 203 to be deposited on the surface of the medium (not shown) to be printed upon. Generally, the medium is maintained in a position which is parallel to the external surface of the orifice plate.

Figure 3:
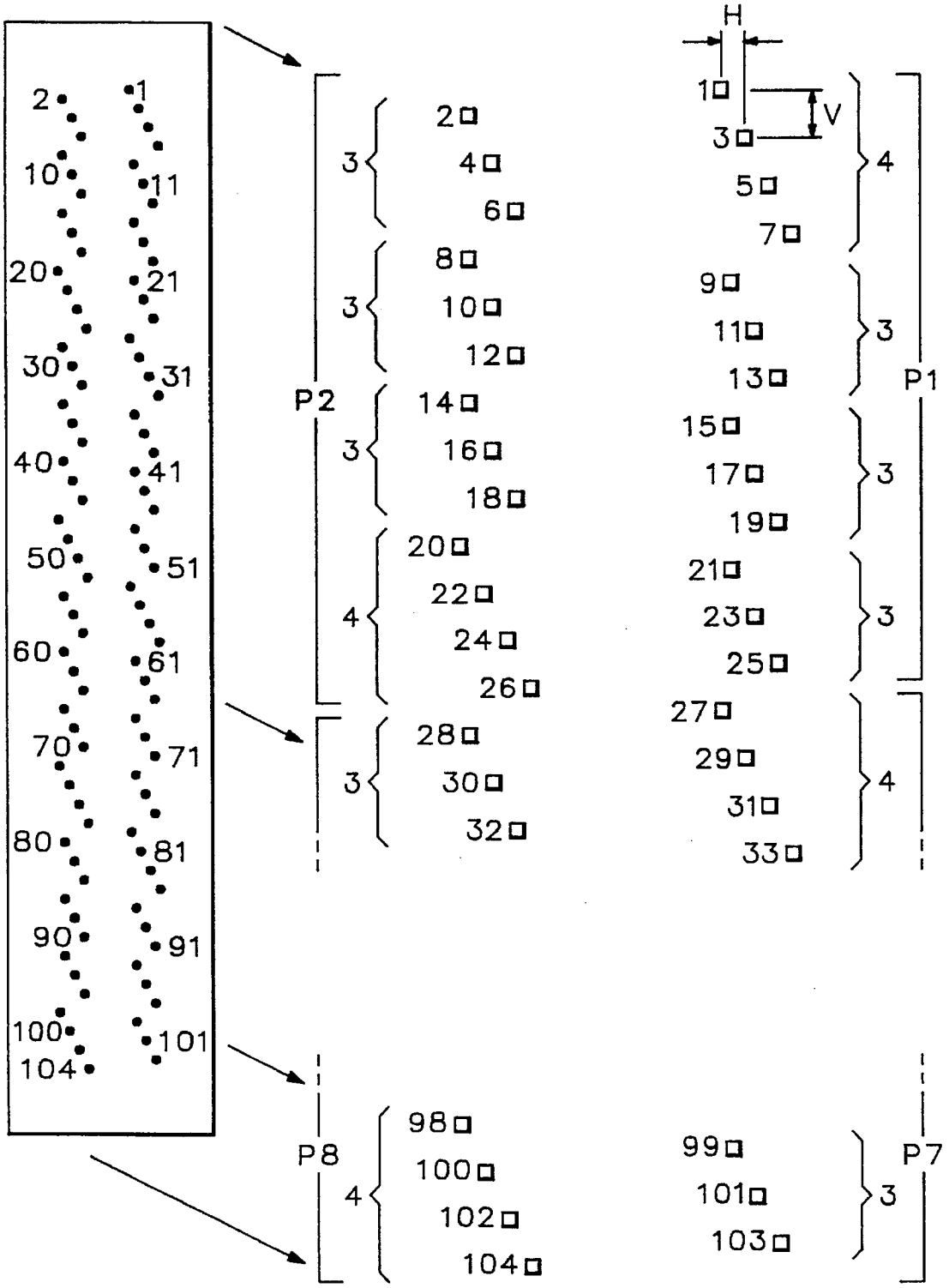
FIG. 3 is a view of the orifices of a printhead and the associated heater resistor arrangement which may be employed in the present invention.

The orifices in the printhead are generally arranged in two major columns of orifices as shown in FIG. 3. For clarity of understanding, the orifices are assigned a number as shown, starting at the top right as the printhead as viewed from the external surface of the orifice plate and ending in the lower left, thereby resulting in the odd numbers being ganged in one column and even numbers being arranged in the second column. Of course, other numbering conventions may be followed but the firing order of the resistors associated with the numbered orifices offers advantages in the present invention.

It is a particular feature of the present invention that the orifices, while aligned in two major columns as described, are further arranged in an offset pattern within each column to match the offset heater resistors disposed in the substrate 211 and which are illustrated to the right in FIG. 3. The resistors are coupled to electrical drive circuitry (not shown in FIG. 3) and are organized in groups of primitives which, in the preferred embodiment, consist of thirteen resistors. The primitives are subdivided into subgroups of resistors (and associated orifices) as shown in FIG. 3. The odd number column (starting with resistor and orifice number 1) begins with a pattern of resistors/orifices (including resistors/orifices 1, 3, 5, and 7) in a subgroup of four, in which resistor/orifice 3 is offset from resistor/orifice 1 by a distance of $H_{1,3}$ in the horizontal dimension and offset from resistor/orifice 1 by a distance of V in the vertical dimension (i.e., in the same direction as the long dimension of the column). In the preferred embodiment, V is approximately 169 to 170 microns. In a similar fashion, resistor/orifice 5 is offset from resistor/orifice 3 by $H_{3,5}$ and V and resistor/orifice 7 is offset from orifice 5 by $H_{5,7}$ and V. Another subgroup of odd numbered resistors/orifices, numbered 9, 11, and 13, are arranged such that resistor/orifice number 9 is offset from resistor/orifice 1 by a horizontal distance of $H_{7,9}$ and offset from resistor/orifice 7 by V. Resistor/orifice 11 is offset from resistor/orifice 9 by $H_{9,11}$ and V, and resistor/orifice 13 is offset from resistor/orifice 11 by $H_{11,13}$ and V. Similar subgroupings of three resistors and orifices are arranged for resistor/orifices 15, 17, and 19 and for resistor/orifices 21, 23, and 25. The pattern of resistor and orifice groupings described above, that is, a 4-3-3-3 pattern, is a primitive and is repeated four times in each major column (P1–P7 and P2–P8)

In the preferred embodiment, the printhead orifices are positioned directly over the heater resistors and are positioned relative to its most adjacent neighbor in accordance with Table 1. Each primitive follows the same spacing and firing pattern. This placement and firing sequence provides a more uniform frequency response for all orifices and reduces the crosstalk between adjacent resistors and orifices. It can be seen, then, that each column width is established as the sum of the offset distances of the subgroup of four resistors/orifices (i.e., $H_{1,3}+H_{3,5}+H_{5,7}+H_{7,9}$). The subgroups of three resistors/orifices have a smaller size in the "H" direction (perpendicular to the long direction of the column).

TABLE 1

| resistor/ orifice no. | 1 | 3 | 5 | 7 | 9 | 11 | 13 | 15 | 17 | 19 | 21 | 23 | 25 | 127 | |
|---|---|---|---|---|---|---|---|---|---|---|---|---|---|---|---|
| Hx,y (microns) | | 12 | 11.5 | 11.5 | 12 | −26.5 | | 11.5 | 12 | −26.5 | | 11.5 | 12 | −26.5 | 11.5 |
| firing order | 1 | 5 | 9 | 13 | 4 | 8 | 12 | 3 | 7 | 11 | 2 | 6 | 10 | 11 | |
| | | | | | | | | | | | | P1 ⟵ \| ⟶ P2 | | | |

Figure 4A:
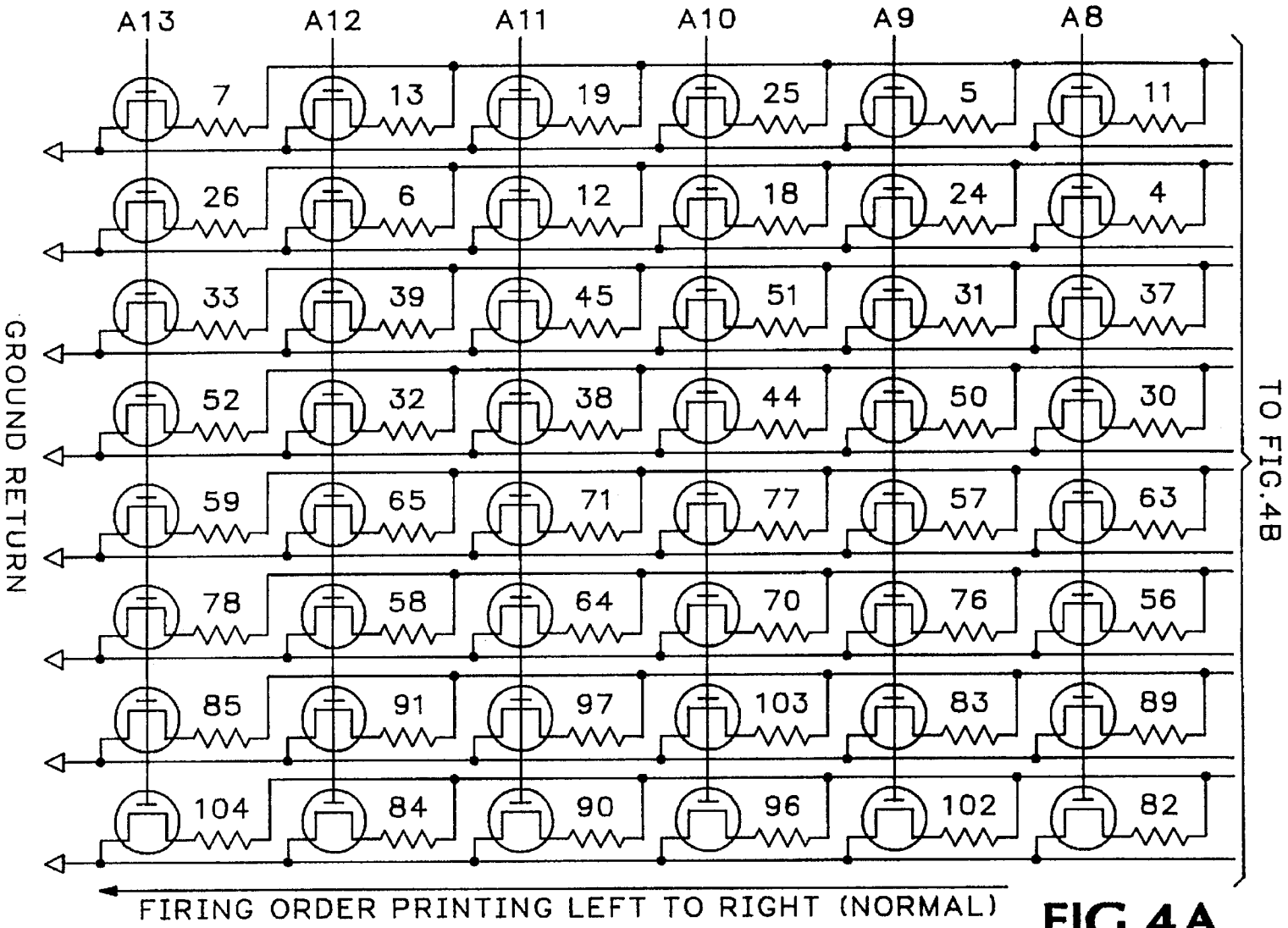
FIGS. 4A and 4B is a schematic diagram of the heater resistors and associated driver transistors which may be employed in the present invention.
Figure 4B:
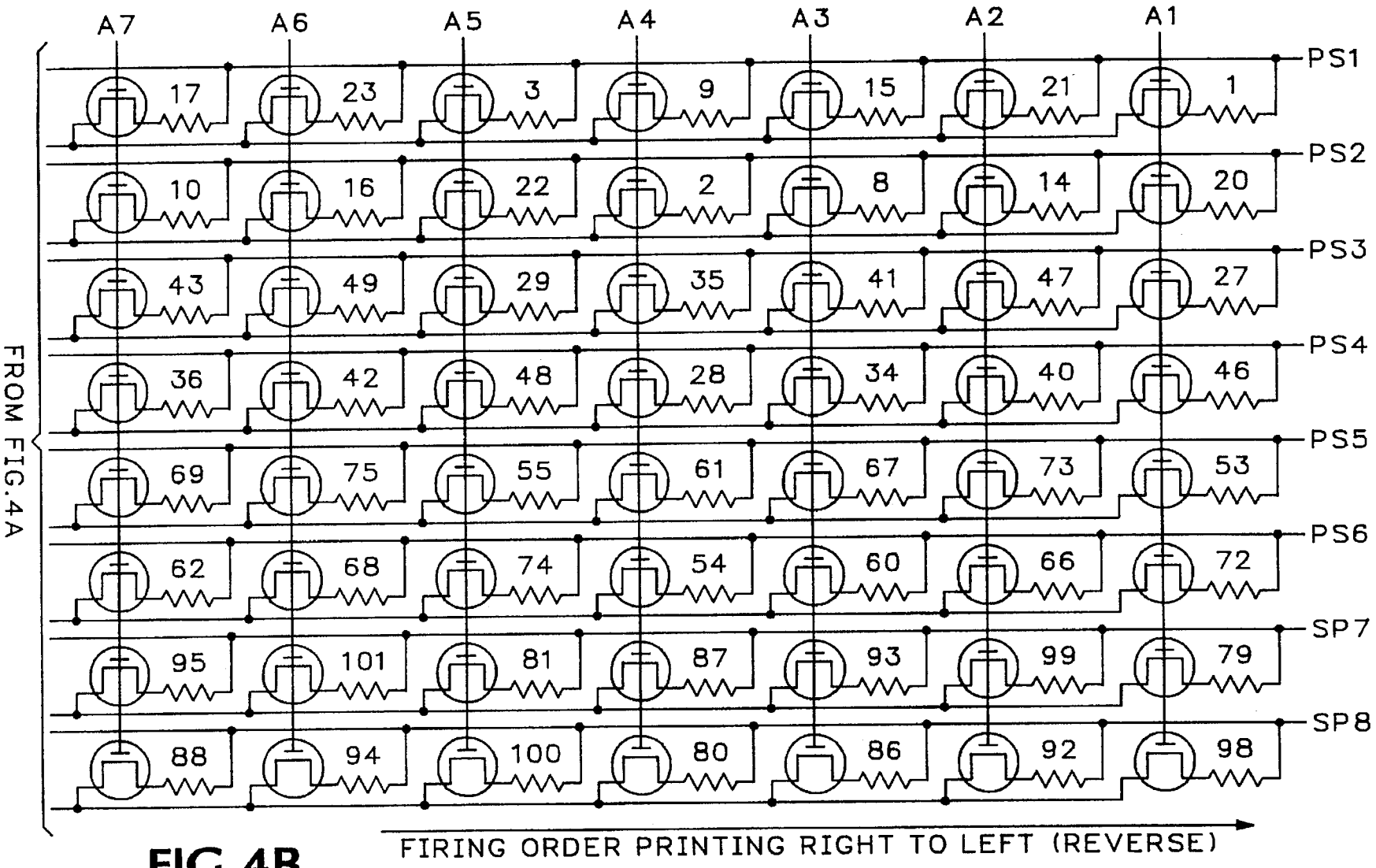
Figure 5:
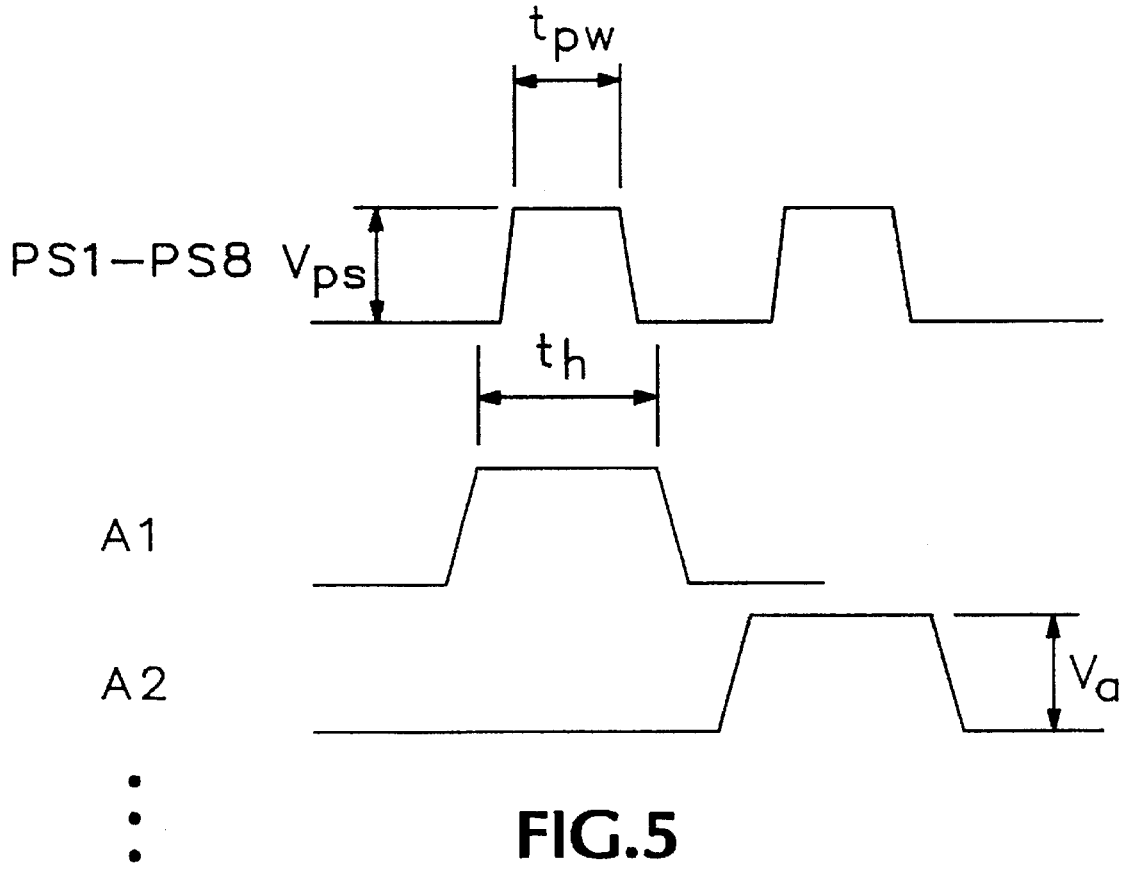
FIG. 5 is a timing diagram illustrating the sequence of signals employed in firing the heater resistors of FIGS. 4A and 4B.

As described, the firing heater resistors of the preferred embodiment are organized as eight groups (primitives) of thirteen resistors. Referring now to the electrical schematic of FIG. 5, it can be seen that each resistor (numbered 1 through 104 and corresponding to the number of orifices of FIGS. 3, 4A and 4B) is controlled by its own FET drive transistor, which shares its control input (Address Select (A1–A13)) with seven others. Each resistor is tied to twelve others by a common node (Primitive Select (PS1–PS8)). Consequently, firing a particular resistor requires applying a control voltage at its "Address Select" terminal and an electrical power source at its "Primitive Select" terminal. Only one Address Select line is enabled at one time. This ensures that the Primitive Select and Ground Return lines supply current to at most one resistor at a time. Otherwise, the energy delivered to a heater resistor would be a function of the number of resistors being fired at the same time.

Figure 6:
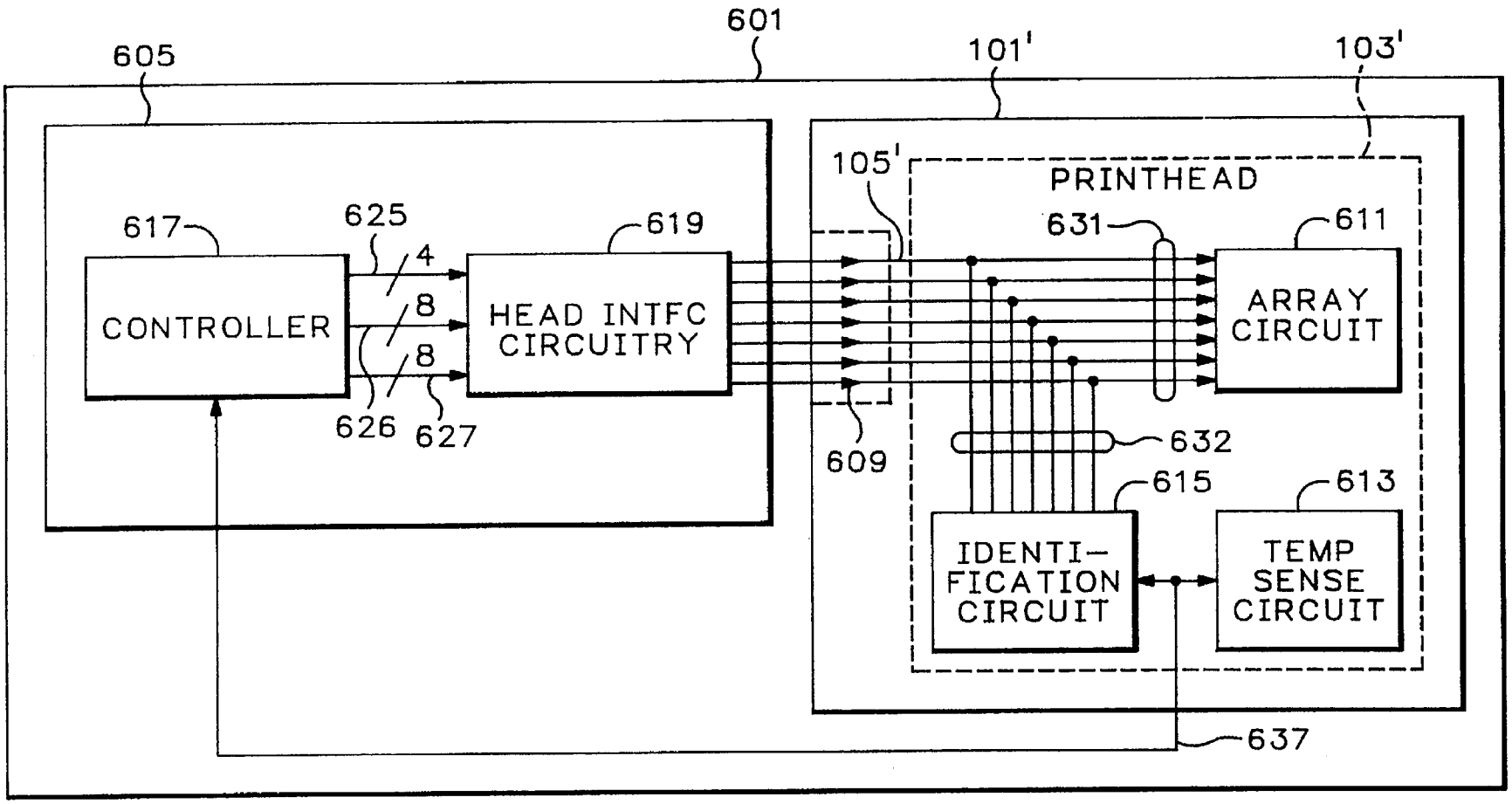
FIG. 6 is an electrical block diagram which illustrates the interconnection of printer elements which may employ the present invention.

The overall printer system is shown, simplified, in the schematic of FIG. 6 where the printer 601 includes a print cartridge 101' and printer electronic circuitry 605. Disposed on a surface of the cartridge 101' is the printhead 103', connected to the circuitry 605 via interface flexible circuit 105'. Printing commands are transmitted from the interface circuitry 605 to driver array circuitry 611 on the printhead 103' through the multiple interconnections of flexible circuit 105'. These interconnections include Primitive Selects, Primitive Common, and Address Select interconnections. The interconnections are operably connected to the driver circuitry on the printhead 103' through various connecting pads 609 for controlling the energizing of heater resistors. Among the circuitry disposed on the integrated printhead 103' to further integrate the printhead functions beyond that of providing the ohmic heater resistors and the active driver transistors (shown here in block form as an array circuit 611), is a temperature sense circuit 613, and a cartridge identification circuit 615.

From the viewpoint of the entire printer, the Address Select lines are sequentially turned on via printhead interface circuitry 619 according to a fire order counter located in the controller 617 and sequenced (independently of the data directing which resistor is to be energized) from A1 to A13 when printing from left to right and from A13 to A1 when printing from right to left. The print data retrieved from the printer memory turns on any combination of the Primitive Select lines. Primitive Select lines (instead of Address Select lines) are used in the preferred embodiment to control the pulse width for two reasons. In the case where there is significant inductance (more than a few inches of conductor trace or cable) between the cartridge and primitive select control drivers, an inductive voltage spike will appear when the current is switched off. Switching with the Address Select lines causes a high voltage positive spike across all off drive transistors in the same primitive. This positive voltage spike could exceed the voltage rating of the transistors. By cuntrolling the pulse width with the Primitive Select lines, only a relatively benign negative spike will appear across the off drive transistors in the same primitive. With an MOS transistor technology, disabling Address Select lines while the drive transistors are conducting high current can cause avalanche breakdown and consequent physical damage. Accordingly, the Address Select lines are "set" before power is applied to the Primitive Select lines, and conversely, power is turned off before the Address Select lines are changed (as shown in FIG. 6). In the preferred embodiment, the nominal voltage ($V_a$) applied to the Address Select lines is 12 volts and the nominal voltage ($V_{ps}$) applied to the Primitive Select lines is approximately nine volts. Each Address Select line is selected for a period of time ($t_h$) of 2.6 microseconds while each Primitive Select line is energized for a period of time ($t_{pw}$) of 2.5 microseconds.

Figure 7:
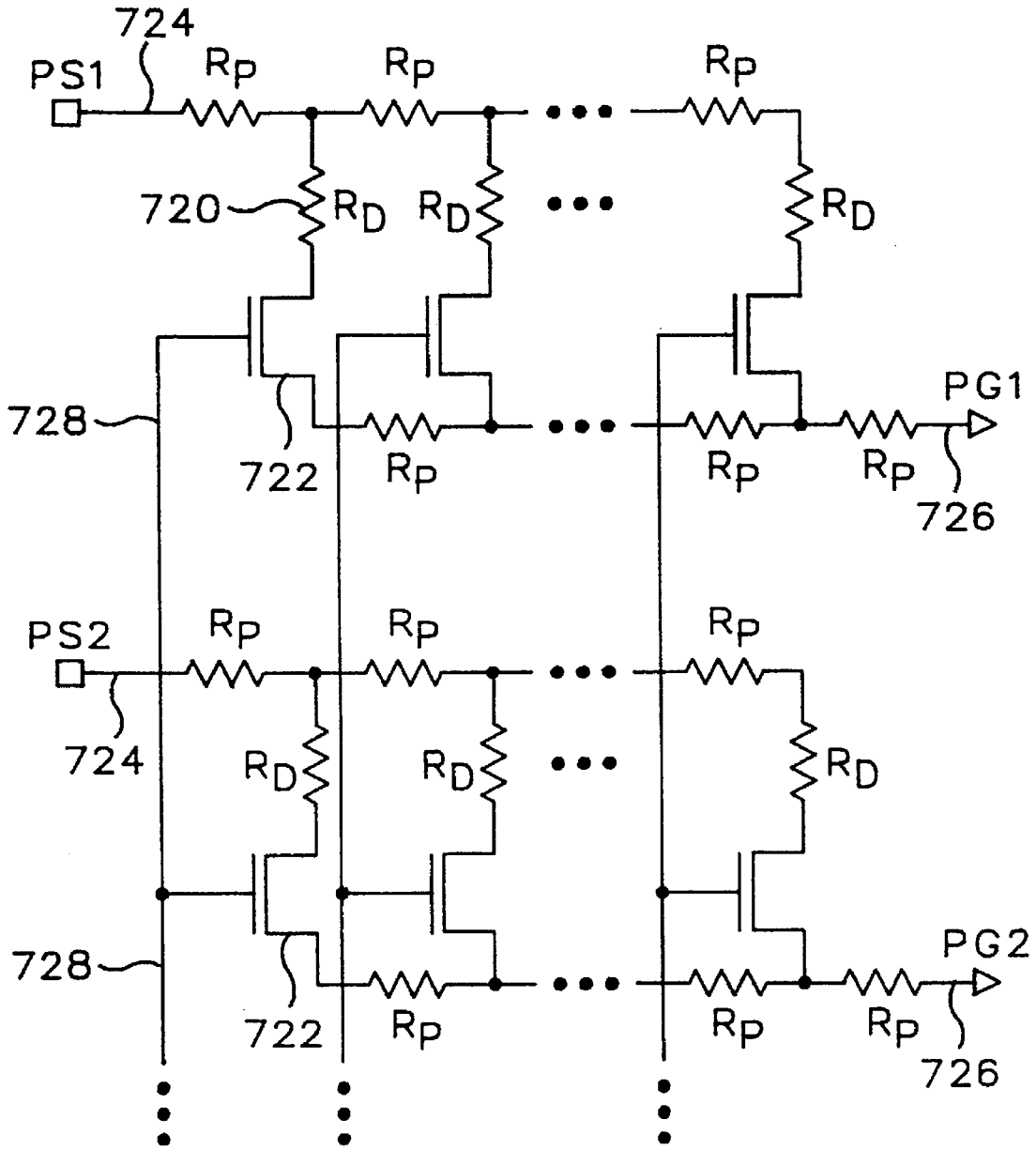
FIG. 7 is a schematic diagram of a portion of the heater resistors and associated transistors and parasitic resistances which may be employed in the present invention.

FIG. 7 illustrates a general portion of the driver matrix (rectangular array) within the driver circuitry on the printhead 103' for selecting which drivers to fire in response to print commands from the printer. While the matrix will be described in terms of rows and columns, it should be understood that these terms are not meant to imply physical limitations on the arrangement of drivers within the matrix or on the printhead. Drivers may be arranged in any manner so long as they can be identified in the matrix by two enable signals within the print command. Each driver generally comprises a heater resistor ($R_D$) 720, a switching transistor 722, a primitive select 724, a primitive common 726, and an address select line interconnection 728 (parasitic resistances ($R_P$) are also shown). The switching transistor 722 is connected in series with the heater resistor 720 between the primitive select 724 and primitive common 726. The Address Select line 728 is also connected to the switching transistor 722 for switching the transistor 722 between a conductive state and a nonconductive state. In the conductive state, the transistor 722 completes a circuit from the primitive select 724 through the heater resistor 720 to the primitive common 726 to energize the heater resistor.

Each primitive (row of drivers) in the matrix is selectively fired by powering the associated primitive select interconnection 724, such as PS1 for the top row shown in FIG. 7. To provide uniform energy per heater resistor 720, the parasitic resistances $R_P$ of the primitive select and common interconnections are carefully balanced, and only one resistor 720 is energized at a time per primitive. However, any number of the primitive selects may be enabled concurrently. Each enabled primitive select 724, such as PS1, PS2, etc., thus delivers both power and one of the enable signals to the driver transistor 722. The other enable signal for the driver matrix is an address signal provided by each address select line 728, such as A1, A2, etc., only one of which is active at a time. Each address select line 728 is tied to all of the switching transistors 722 in a matrix column so that all such switching devices are conductive when the interconnection is enabled. Where a primitive select interconnection 724 and an address select line 728 for a heater resistor $R_D$ 720 are both active simultaneously, that particular heater resistor is energized.

The interconnections for controlling the printhead driver circuitry of FIG. 7 include separate primitive select and primitive common interconnections for each matrix column. The driver matrix of the preferred embodiment comprises an array of eight primitives, eight primitive commons, and thirteen address select lines thus requiring 29 interconnections.

Figure 1:
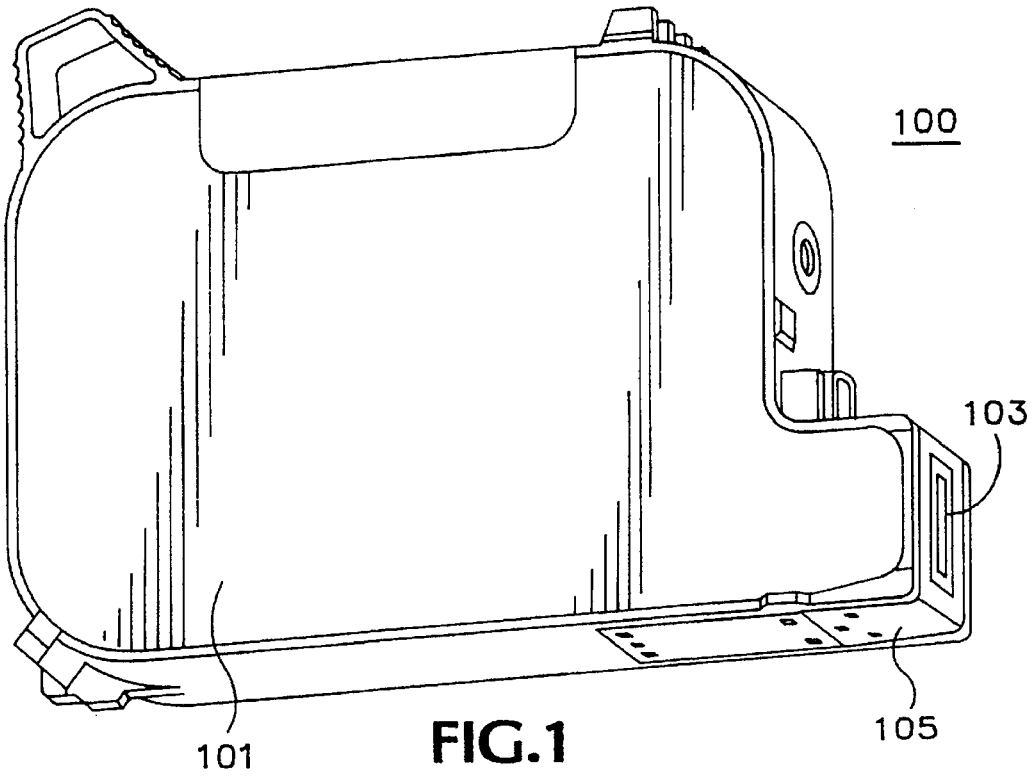
FIG. 1 is an outline drawing of a printer cartridge which may employ the present invention.
Figure 8:
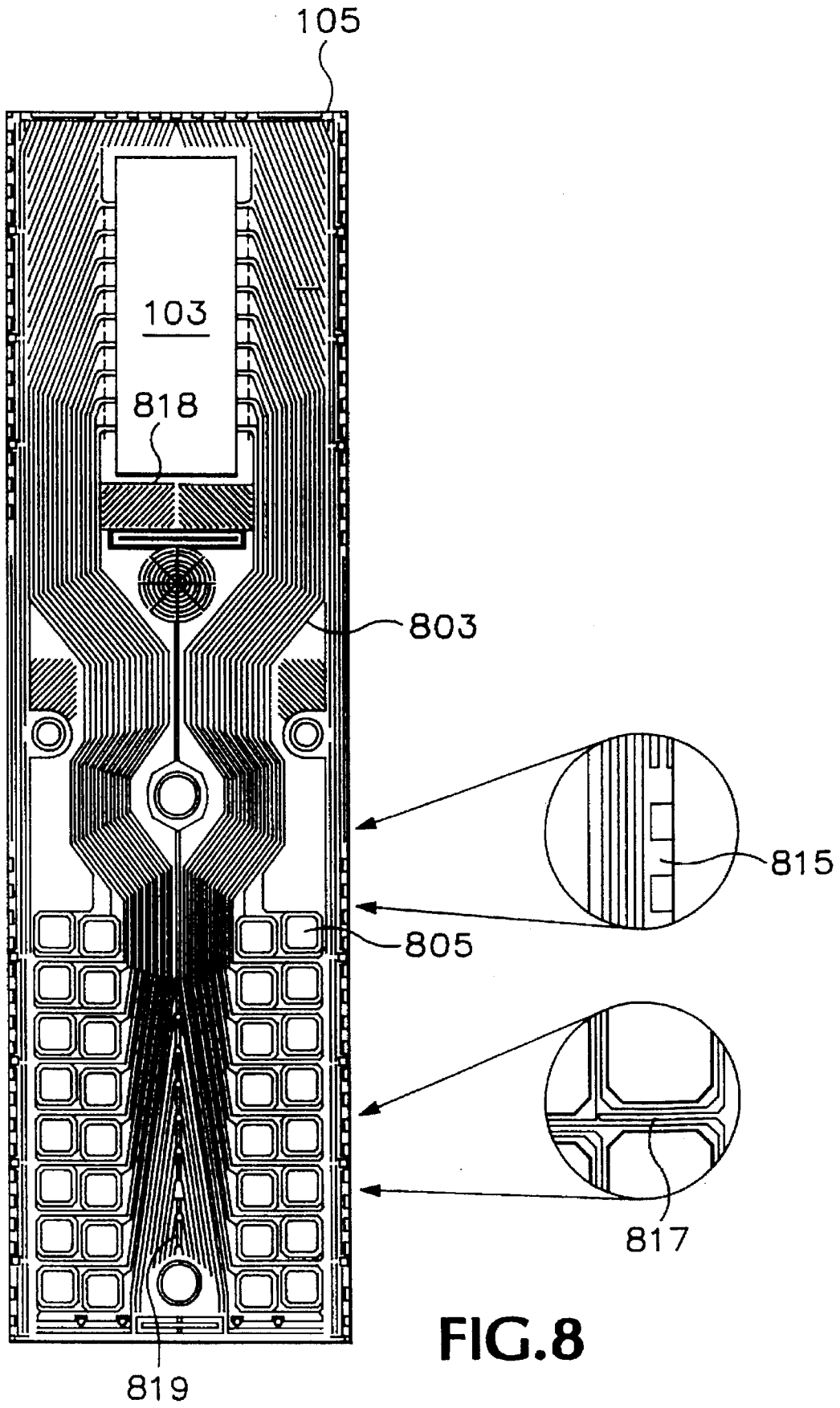
FIG. 8 is a physical layout of an interconnecting flexible circuit which may be employed in the present invention.

For the flexible circuit 105 of FIG. 1, a planar view of the flexible circuit is shown in FIG. 8. The printhead 103 is connected to the printer by way of this flexible circuit. The base material of the flexible circuit 105, a tape, may be purchased commercially as Kapton™ tape, available from 3M Corporation. Other suitable tape may be formed of Upilex™ or its equivalent. A surface of the tape includes a plurality of conductive traces, for example trace 803, formed thereon using conventional photolithographic etching and/or plating processes. In the preferred embodiment, these traces are disposed on the back surface of the tape, the surface in contact with the cartridge body. For ease of understanding, no distinction is made in FIG. 8 between back and front surfaces relative to the location of the traces. These conductive traces are terminated by a plurality of contact pads, for example contact pad 805, designed to interconnect with a printer. The print cartridge is designed to be installed in a printer so that the contact pads, on the front surface of the tape, contact printer electrodes which couple externally generated energization signals to the printhead. In the preferred embodiment, the contact or interface pads are assigned the functions listed in Table 2.

TABLE 2

| Pad no. | Function | Pad no. | Function |
|---|---|---|---|
| 1 | Primitive select 1 | 2 | Primitive select 2 |
| 3 | Address Select 13 | 4 | Address Select 1 |
| 5 | Address Select 12 | 6 | Address Select 2 |

TABLE 2-continued

| Pad no. | Function | Pad no. | Function |
|---|---|---|---|
| 7 | Common 1 | 8 | Common 2 |
| 9 | Primitive Select 3 | 10 | Primitive Select 4 |
| 11 | Address Select 11 | 12 | Address Select 3 |
| 13 | Address Select 10 | 14 | Address Select 4 |
| 15 | Common 3 | 16 | Common 4 |
| 17 | Primitive Select 5 | 18 | Primitive Select 6 |
| 19 | Address Select 9 | 20 | Address Select 5 |
| 21 | Address Select 8 | 22 | Address Select 6 |
| 23 | Common 5 | 24 | Common 6 |
| 25 | Primitive Select 7 | 26 | Primitive Select 8 |
| 27 | Address Select 7 | 28 | Thermal Sense 1 |
| 29 | ESD Ground | 30 | Common 8 |
| 31 | Common 7 | 32 | Thermal Sense 2 |

To access the traces on the back surface of the tape from the front surface of the tape, holes (vias) are formed through the front surface of the tape to expose the ends of the traces. The exposed ends of the traces are then plated with, for example, gold to form the contact pads (for example, pad 805) shown on the front surface of the tape in FIG. 8.

In the print cartridge 100 of FIG. 1, the flexible circuit 105 is bent over the edge of the print cartridge "snout" and extends approximately one third the length of one wall of the snout. The contact pads are located on the flexible circuit which is secured to this wall and the conductive traces are routed over the bend and are connected to the substrate electrodes through the window in the flexible circuit.

An illustrative example of an electrostatic (ESD) protection structure is shown in FIG. 8. The conductive grounding pattern includes various interconnected conductive grounding areas and/or traces that are formed on the substrate in the same manner as the conventional interconnect lines and interconnect pads, including a plurality of narrow comb-like tabs 815 distributed adjacent and generally normal to certain edges of the circuit. These tabs 815 function as field concentrating electrodes that promote discharge of ESD, where such discharge can be to an external ground plane or from physical handling by a person and spark gaps 817 that provide for discharge paths between the interconnect pads and the ESD conductive grounding pattern. A spark gap 817 of the ESD protection structure is formed by a first tab separated from several interconnect pads. The intent is to provide field concentrating regions that have a field breakdown voltage that is significantly less than the breakdown voltage between adjacent conductive elements forming the interconnect lines and pads; i.e., the spark gaps are configured such that the voltage required to produce a spark in a spark gap is less than the voltage required to produce a spark between adjacent conductive interconnect elements. The spark gaps are preferably located as far away from the printhead as practicable so as to maximize the impedance presented by the interconnect traces between the spark gaps and the printhead.

The conductive grounding pattern also includes a conductive grounding pattern 818 that extends along and is adjacent the perimeter of the silicon substrate 103, and which surrounds the interconnect metallization portion and the printhead region. The effective width of the ground ring pattern is greater than the width of each of the interconnect traces. The conductive ground ring pattern is electrically connected to the substrate ground of the printhead via a ground trace, a grounding pad (#29), and a ground trace 819 that is routed between interconnect lines.

The grounding conductive pattern generally is limited to those perimeter and opening edges that have interconnect or ESD sensitive components in the proximate area and which are unsealed and therefore subject to physical handling and/or ESD discharge. One of the functions of the conductive grounding components adjacent perimeter and opening edges is to provide discharge paths to an external ground plane, such as when the cartridge is placed on a conductive surface. Accordingly, conductive grounding areas and/or traces are provided adjacent perimeter and interior substrate edges which by virtue of location on the product might provide discharge paths to an external ground plane, regardless of whether interconnect or ESD sensitive components are in the proximity of the edges.

As mentioned previously, the integration of both heater resistors and FET driver transistors onto a common substrate has created a need for additional layers of conductive circuitry on the substrate so that the transistors could be electrically connected to the resistors and other components of the system. These additional layers have resulted in increased production and material costs. With reference to FIGS. 9–13, cross sectional representations of the printhead semiconductor substrate are provided which illustrate the process steps necessary to electrically connect the electrical contact regions of the drive transistors with the heater resistors and other printer components in the preferred embodiment. The term "electrical contact regions" for the preferred embodiment represents the source, gate, and drain of a field effect transistor.

Figure 9:
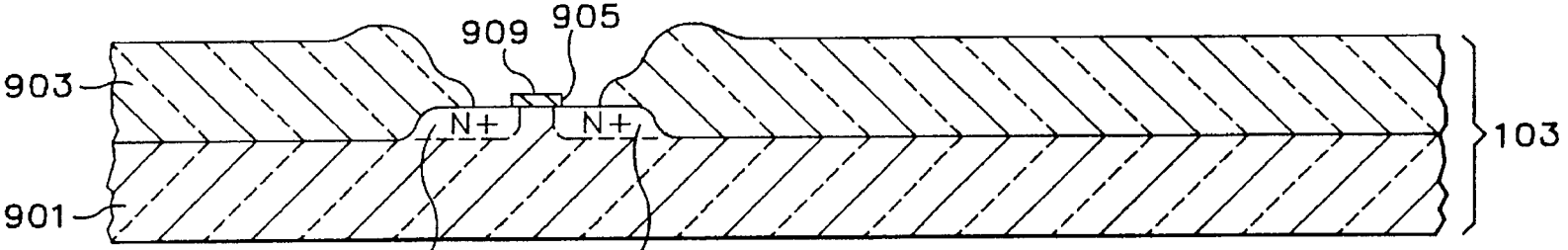
FIGS. 9 through 13 are cross sectional views of the printhead substrate, illustrating the process of construction of the printhead substrate which may employ the present invention.

FIG. 9 illustrates a portion of the multi-layer substrate 103 which, in a preferred embodiment, has a lower portion 901 manufactured of P-type monocrystalline silicon and preferably has a thickness of about 24–26 mils. The substrate 103 further includes an upper layer 903 of silicon dioxide which is formed by thermal oxidation. Alternatively, upper layer 903 may be formed by a CVD process, heating the lower portion 901 in a mixture of silane, oxygen, and argon at a temperature of about 300–400 degrees C. until the desired thickness of silicon dioxide has been formed, as discussed in U.S. Pat. No. 4,513,298. Another alternative is the use of an upper layer 903 which comprises a combination of a thermally grown oxide layer and a CVD layer as described above (but not shown). In any event the upper layer 903 has a preferred thickness of about 10,000–24,000 angstroms.

Figure 10:
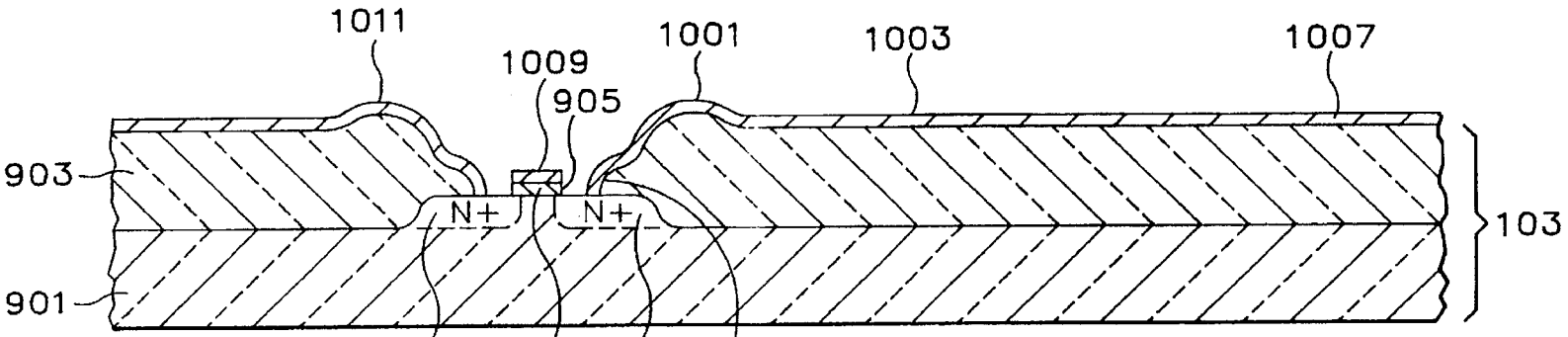

Integrally formed on the substrate 103 is a plurality of drive transistors, one of which is schematically illustrated at reference number 905 in FIG. 9. Basically, the transistor 905 is of the field effect silicon-gate variety, and includes a source diffusion 907, gate 909, and drain diffusion 911, all of which define electrical contact regions to which various components (e.g. resistors) and electrical circuitry may be connected. Next, a layer 1001 of electrically resistive material is applied directly on top of the upper layer 903 of the substrate 103 (FIG. 10). As shown in FIG. 10, the layer 1001 includes a first section 1003 having a first end 1005 and a second end 1007. The first section 1003 is continuous and uninterrupted from end 1005 to end 1007. In addition, end 1005 is in direct physical contact with drain diffusion 911 of transistor 905 as illustrated, with no intervening layers of material therebetween. The layer 1001 also consists of a second section 1009 which is positioned in direct electrical/physical contact with gate 909 of the transistor 905, and is electrically separated from the first section 1003 of the layer 1001. Furthermore, the layer 1001 includes a third section 1011 which is electrically connected to the source diffusion 907 of the transistor 905.

In the preferred embodiment, the resistive material used to form layer 1001 is manufactured of aluminum and tantalum, however, tantalum nitride or phosphorous-doped polycrystalline silicon may be used. The tantalum-aluminum layer 1001 is applied at a uniform thickness of about 770–890 angstroms.

Figure 11:
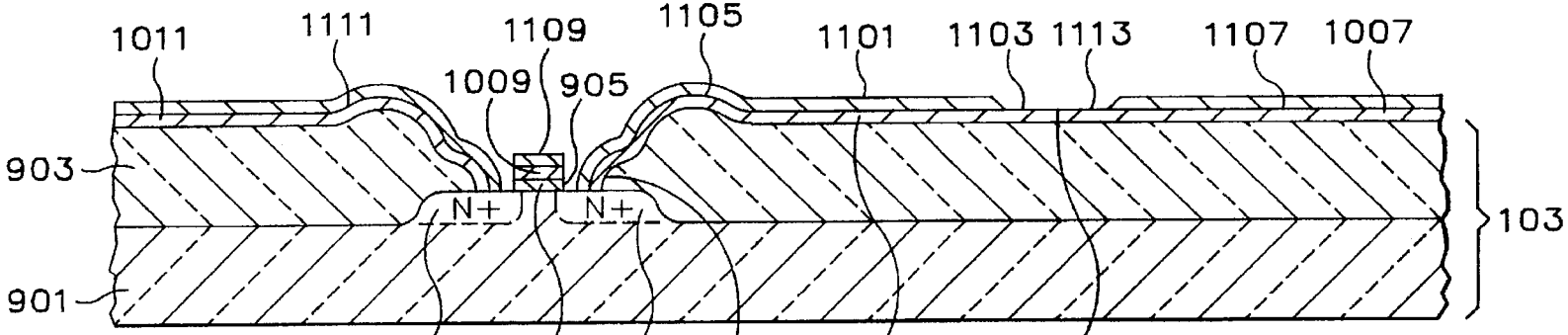

With reference to FIG. 11, a conductive layer 1101 is then applied directly on selected portions of the layer 1001 of resistive material. In a preferred embodiment, the conductive layer may consist of aluminum, copper, or gold, with aluminum being preferred. In addition, the metals used to form the conductive layer 1101 may be optionally doped or combined with other materials, including copper and/or silicon. If aluminum is used, the copper is designed to control problems associated with electro-migration, while the silicon is designed to prevent side reactions between the aluminum and other silicon-containing layers in the system. In general, the conductive layer 1101 has a uniform thickness of about 4000–6000 angstroms, and is applied using conventional sputtering or vapor deposition techniques.

As shown in FIG. 11, the conductive layer 1101 does not completely cover all portions of layer 1001 of resistive material. Specifically, only part of the first section 1003 is covered. The second section 1009 and the third section 1011 are entirely covered. The resistive layer 1001 is basically divided into an uncovered section 1103 and covered sections 1105, 1107, 1109, and 1111. The uncovered section 1103 functions as a heater resistor 1113 which causes ink bubble nucleations during print cartridge operation. The covered section 1105 serves as a direct conductive bridge between the resistor 1113 and the drain diffusion 911 of the transistor 905, and electrically couples these components together.

From a technical standpoint, the presence of conductive layer 1101 over the layer 1001 of resistive material defeats the ability of resistive material (when covered) to generate significant amounts of heat. Specifically, the electric current, flowing via the path of least resistance, will be confined to the conductive layer 1101, thereby generating a minimal amount of thermal energy. Thus the layer 1001 only functions as a resistor at the uncovered section 1103.

Figure 12:
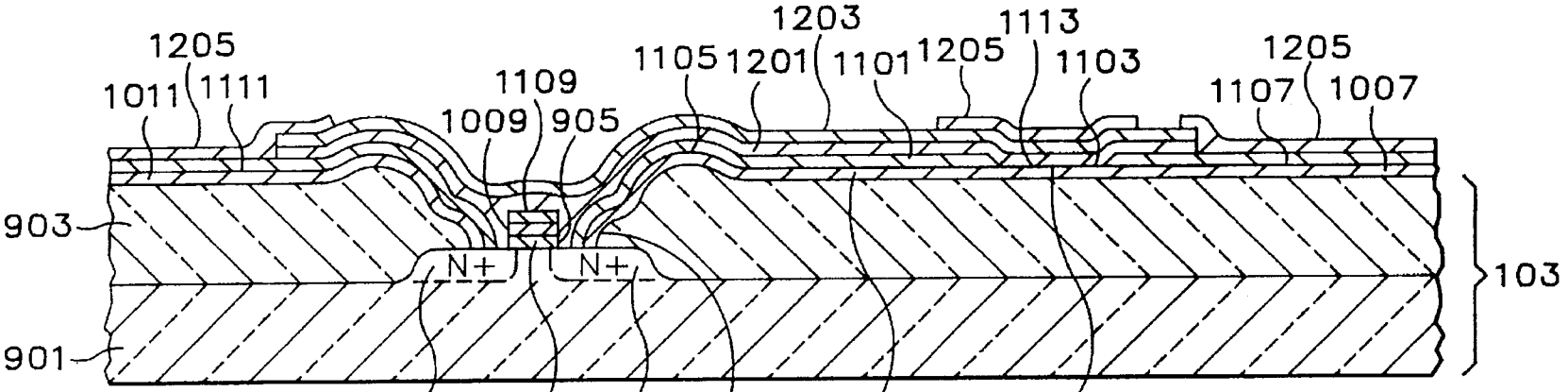

Referring now to FIG. 12, several layers of material are deposited over the resistor 1113, transistor 905, and conductive layer 1101. A first passivation layer 1201 is deposited which preferably consists of silicon nitride and results from the decomposition of silane mixed with ammonia. The layer 1201 covers the resistor 1113 and the transistor 905 as illustrated. The main function of the passivation layer 1201 is to protect the resistor 1113 (and the other components) from the corrosive action of the ink used in the cartridge. This is especially important with respect to resistor 1113, since any physical damage to it can dramatically impair its basic operational capabilities. The passivation layer 1201 preferably has a thickness of about 4000–6000 angstroms. A second passivation layer 1203 which is preferably manufactured of silicon carbide formed from silane and methane. The layer 1203 covers the layer 1201 as illustrated and is also designed to protect the resistor 1113 and other components from corrosion damage. A conductive cavitation layer 1205 is selectively applied to various areas of the circuit as illustrated. The principal use of the cavitation layer 1205 is over the portion of the second passivation layer 1203 which covers the resistor 1113. The purpose of the cavitation layer 1205 is to minimize mechanical damage to the resistor 1113 and dielectric passivation films. In a preferred embodiment, the cavitation layer 1205 consists of tantalum, although tungsten or molybdenum may also be used. The cavitation layer 1205 is preferably applied by conventional sputtering techniques, and is normally 5500–6500 angstroms thick.

Figure 13:
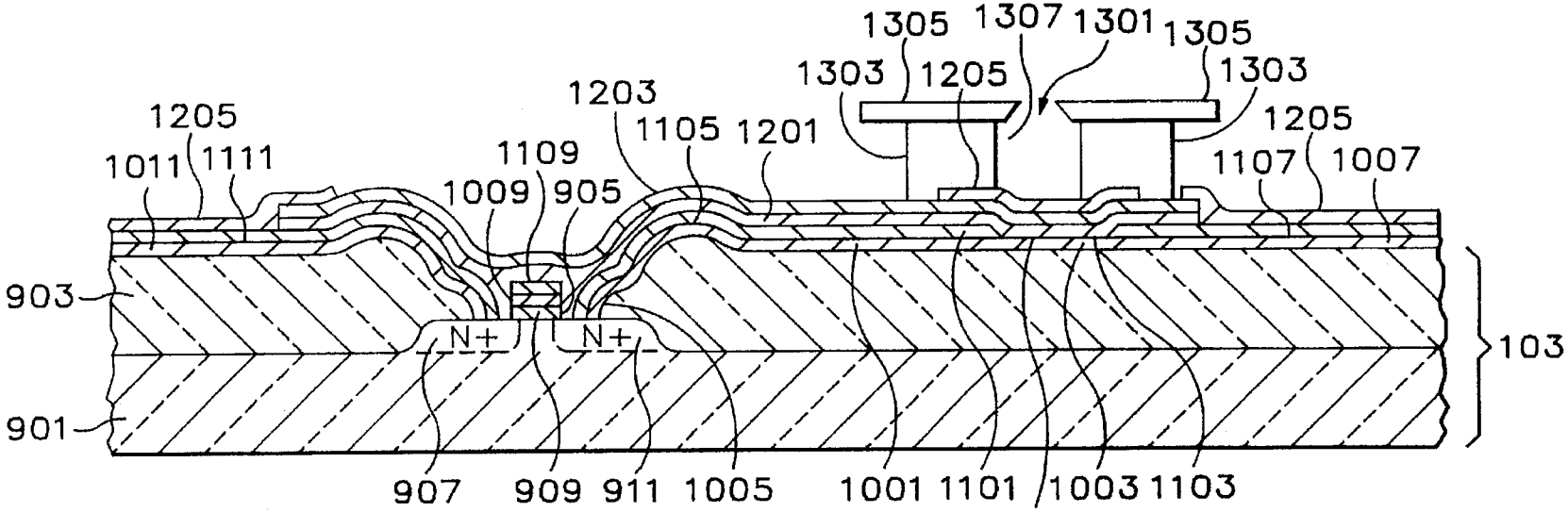

One orifice 1301 of the printhead is shown in the cross section of FIG. 13. An ink barrier layer 1303 is selectively applied to and above the cavitation layer 1205 and portions of the second passivation layer 1203 on both sides of the resistor 1113 as illustrated. The barrier layer 1303 is preferably made of an organic polymer plastic which is substantially inert to the corrosive action of ink. Exemplary plastic polymers suitable for this purpose include products sold under the names VACREL and RISTON by E. I. DuPont de Nemours and Co. of Wilmington Del. These products are applied to the cavitation barrier layer 1205 by conventional lamination techniques. In the preferred embodiment, the barrier layer 1303 has a thickness of about 200,000–300,000 angstroms. It is designed to control refilling and collapse of the ink bubble during bubble nucleation, and also minimizes cross-talk between adjacent resistors in the system. Furthermore, the materials listed above can withstand temperatures as high as 300 degrees C., and have good adhesive properties for holding the orifice plate of the printhead in position.

An orifice plate 1305 is applied to the surface of the barrier layer 1303 as partially shown. The orifice plate 1305 controls both drop volume and direction, and includes a plurality of openings therein, each opening corresponding to at least one of the resistors in the system. The orifice plate 1305 includes an opening 1301 which is directly above and aligned with the resistor 1113. In addition, a section of the barrier layer 1303 directly above the resistor 1113 is removed or selectively applied in a conventional manner during the manufacturing process in order to form an ink firing chamber 1307, which is designed to receive ink from the source within the cartridge. Activation of the resistor 1113 imparts heat to the ink within the firing chamber 1307 through layers 1201, 1203, 1205, resulting in bubble nucleation. The resistor 1113 is connected to a conventional source of drain voltage (located externally in the printer unit) via covered section 1107 of layer 1101 which is in direct physical contact with the conductive cavitation layer 1205. Cavitation layer 1205 communicates with an external contact layer of conductive metal (e.g. gold, not shown). An identical configuration exists with respect to connection of the source diffusion 907 of the transistor 905 to an external ground. Connection is accomplished via the covered section 1111 of layer 1101. The covered section 1111 is electrically connected to the ground through cavitation layer 1205 and an external contact layer. Finally, an external lead may be connected to the gate 909 of the transistor 905 directly through the passivation layers 1201 and 1203.

Figure 14:
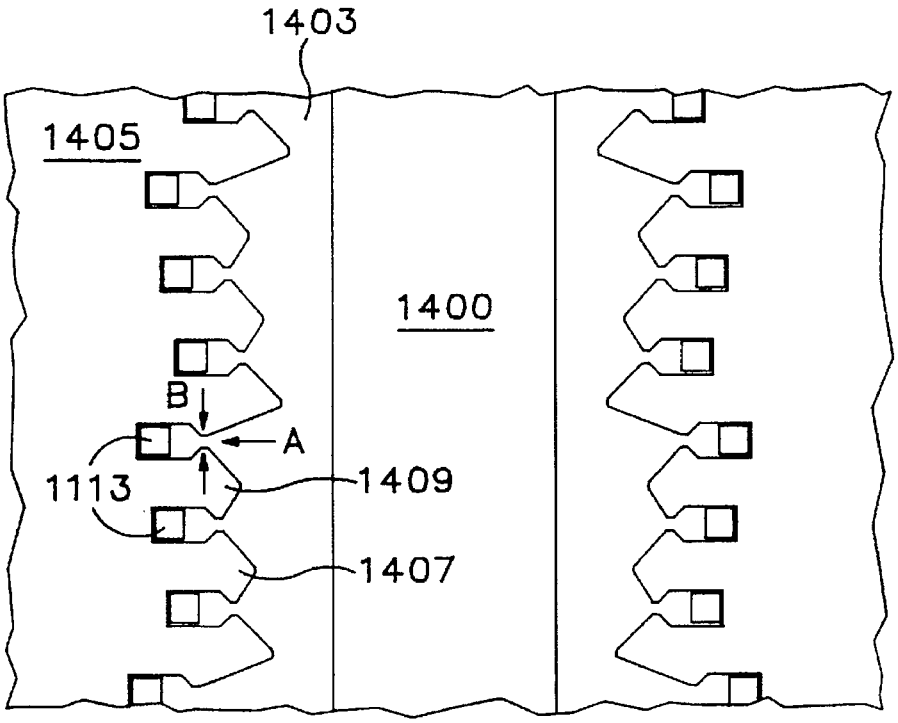
FIG. 14 is a view of the top surface of a printhead substrate illustrating the orientation of heater resistors, ink barrier layer, and ink feed aperture which may be employed in the present invention.

The flow of ink into the firing chamber 1307 may be considered relative to FIG. 14. FIG. 14 is a top view of the firing chamber 1307 with the orifice plate removed for clarity. Three heater resistors 1113 are shown as rectangular areas in the substrate, and a common ink fill aperture 1400 is shown to provide a supply of ink to the firing areas. While the preferred embodiment illustrates the use of a common ink fill aperture or slot substantially centrally located in the printhead substrate, an alternative embodiment may successfully employ a non-central ink fill or an edge-feed ink fill to the firing chambers. See, for example, U.S. Pat. No. 5,278,584. Ink (not shown) is introduced at a constricted end of the firing chamber, as indicated by the arrow "A", from the ink fill aperture. A pair of opposed projections, indicated by the arrow "B", at the entrance to the firing chamber provide the localized constriction.

Figure 16:
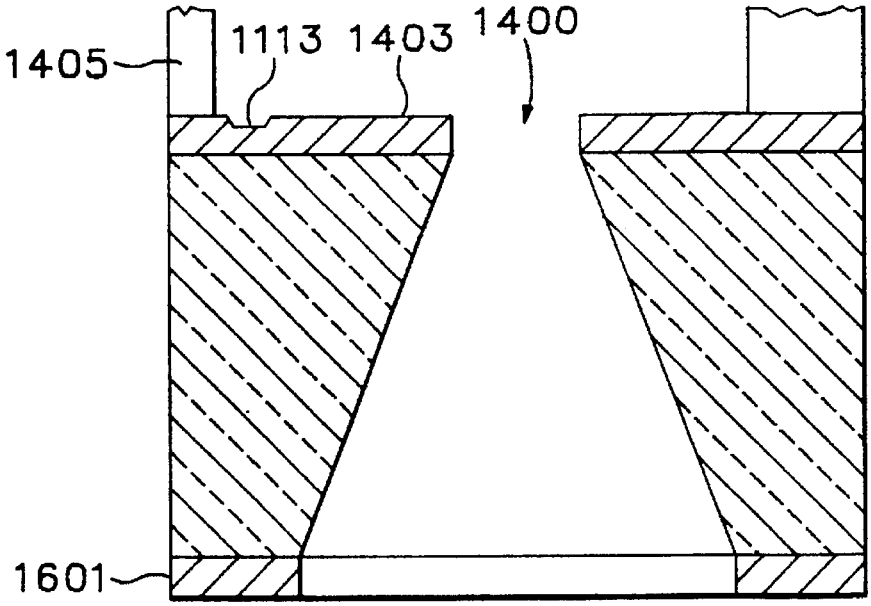
FIGS. 16 and 17 are cross sectional views of the printhead substrate illustrating the ink feed aperture and extension channel which may be employed in the present invention.

Each such printing element comprises a heater resistor 1113 set in a firing chamber 1307 defined by three barrier walls and a fourth side open to the ink fill aperture 1400 of ink common to at least some of the elements. In a preferred embodiment, an ink fill aperture 1400 is created in conventional fashion through the center of the semiconductor substrate as shown. Ink is sourced from beneath the substrate and supplied to each firing chamber surrounding each firing resistor (for example, resistor 1113) across a shelf 1403. The firing chamber is defined by a barrier layer material 1405 which is deposited on the surface of the semiconductor substrate. The alignment can be seen in the cross section of the semiconductor substrate and barrier layer as illustrated in FIG. 16.

Figure 15:
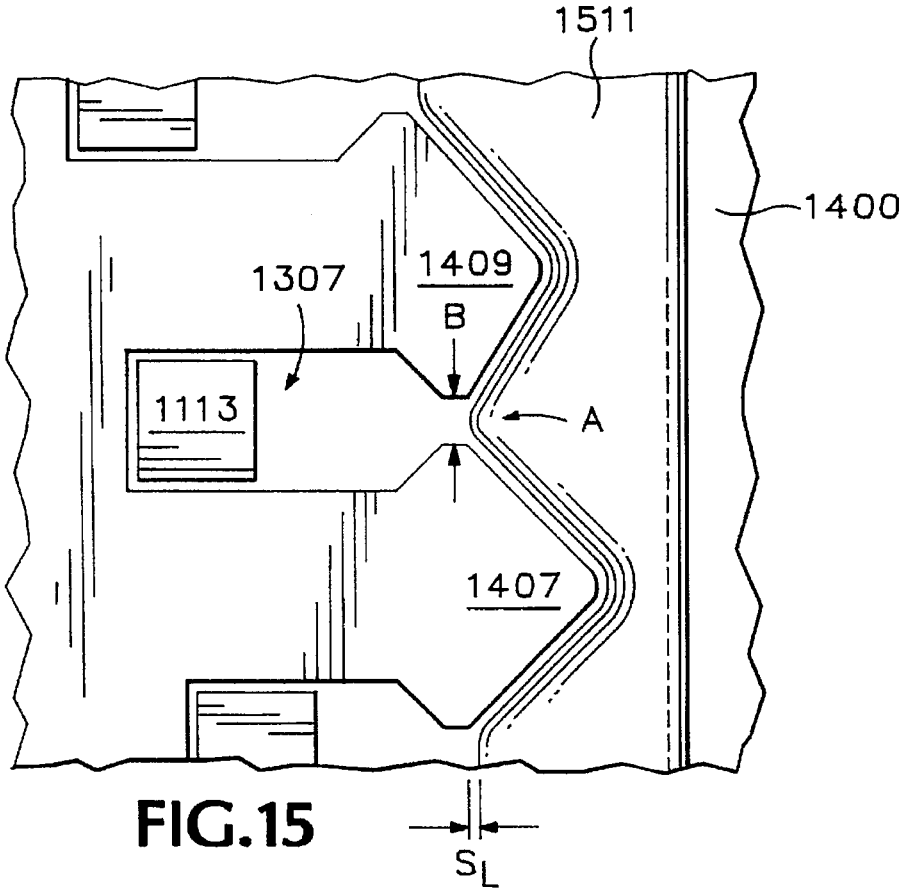
FIG. 15 is a less magnified view of FIG. 14.

In an alternative embodiment, the effective shelf length to each firing chamber is reduced by creating an extension channel from the ink fill aperture to the firing chamber as shown in FIG. 15. The ink fill aperture 1400 is extended to a pair of lead-in lobes 1407, 1409 of each firing chamber, at a predetermined distance from the entrance to the firing chamber, as shown in FIGS. 14 and 15. The ink fill aperture 1400 is extended the varying distances to the constriction in the barrier layer wall opening by means of extension channels 1511 toward the lead-in lobes 1407 and 1409, using precise etching to controllably align the ink fill aperture and extension channels relative to the entrance to the firing chamber, indicated at "A". Use of precise etching permits a shorter shelf length, $S_L$, to be formed; this shelf length is shorter than that of other commercially available printer cartridges and permits firing at higher frequencies.

The frequency limit of a thermal inkier pen is limited by resistance in the flow of ink to the nozzle. However, some resistance in ink flow is necessary to damp meniscus oscillation but too much resistance limits the upper frequency at which a print cartridge can operate. Ink flow resistance (impedance) is intentionally controlled by the gap adjacent the resistor 1113 with a well-defined length and width. See, for example U.S. Pat. No. 4,882,595. The distance of the resistor 1113 from the ink fill aperture 1400 varies with the firing patterns of the printhead. An additional component to the fluid impedance is the entrance "A" to the firing chamber. The entrance comprises a thin region between the orifice plate and the substrate and its height is essentially a function of the thickness of the barrier material. This region has high fluid impedance, since its height is small.

As the shelf length $S_L$ increases in length, the nozzle frequency decreases. In the alternative embodiment shown in FIG. 15 the substrate is etched in this shelf to form the extension channel 1511 from the ink fill aperture 1400, thereby reducing the shelf length. As a consequence, the fluid impedance is reduced, resulting in a more uniform frequency response for all nozzles. In this instance where the printhead ejects ink droplets of about 130 pl volume, a shelf length $S_L$ of about 10 to 50 mm is employed.

Figure 17:
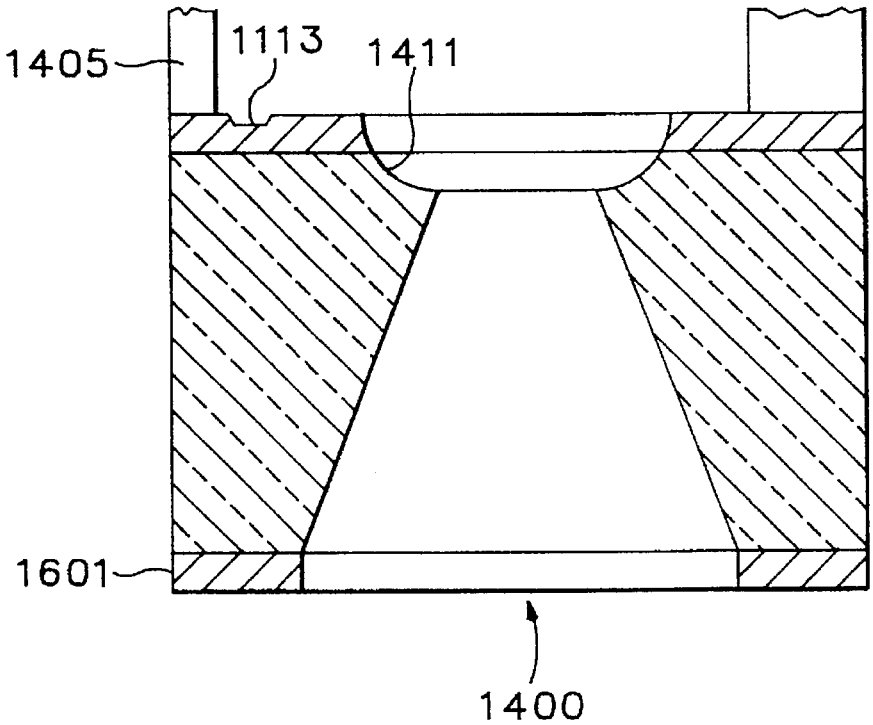

One method of fabrication of the ink fill aperture is achieved by first masking the semiconductor substrate 103 with thermally grown oxide 1601 to protect areas not to be etched. Openings are photodefined in the etch mask using conventional microelectronics photolithographic procedures to expose the silicon on the secondary (back) surface to be removed in the desired ink flow channel areas. The silicon substrate is then etched part way into the back surface through the exposed areas of the openings as shown in FIG. 16 to form the ink fill aperture 1400, using anisotropic etchants to provide the desired geometric characteristics of the ink flow channels. In an alternative embodiment the front surface is etched as shown in FIG. 17 to connect with the ink fill aperture 1400 and to provide the extension channels 1511 from the ink fill aperture 1400 to the entrances of the ink firing chambers. The barrier layer and defined firing chamber 1307 and firing chamber, along with resistor heater 1113 and associated electrical traces, are formed in separate steps prior to this step (and not shown here for clarity). The etching in this step may be done using an isotropic etchant, such as dry (plasma) etching.

Figure 18:
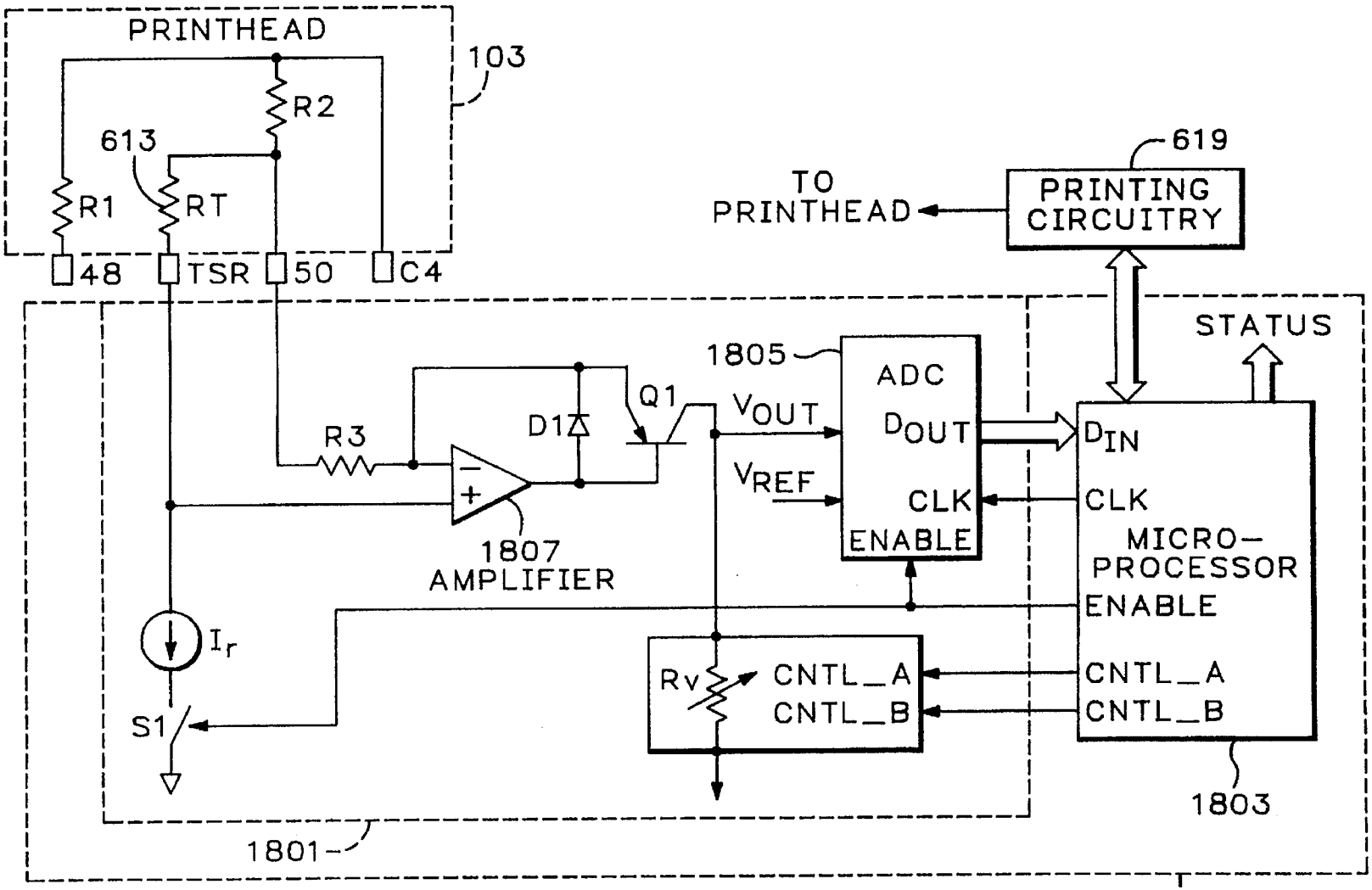
FIG. 18 is an electrical block diagram illustrating an ink flow detector which may be employed in the present invention.

A circuit 1801 to detect the sufficiency of ink flow is shown in the schematic diagram of FIG. 18. The cimuit is preferably mounted within the printer it controls, and is part of controller 617. At the left of the figure is a portion of a thermal inkjet printhead 103, including heater resistors such as R1, R2 and a thermal sense resistor RT, which is equivalent to the temperature sense circuit shown as element 613. RT is a temperature sensor whose resistance increases with increasing temperature. In the present embodiment, it is deposited on the printhead substrate 103 as a thin film resistor along with the heater resistors. The substrate, which in the preferred embodiment is silicon, has a high thermal conductivity and heats as the heater resistors are pulsed to eject ink droplets through the nozzles of the printhead. The substrate, in turn, heats the thermal sense resistor RT, thereby increasing its resistance.

The rate of temperature rise of the substrate toward an equilibrium value depends, among other things, upon the volume of ink being ejected from the nozzles during printing. The rate increases as the volume of ink droplets ejected during printing decrease. The reason for this phenomenon is that the liquid ink leaving the printhead removes heat from the printhead. As the amount of liquid ink being ejected, decreases, the amount of heat energy being removed decreases. The heat formerly removed by the ink flow is instead absorbed by the printhead substrate, which causes the substrate's temperature to rise at a faster rate than it otherwise would. If little or no ink is ejected, the substrate's temperature rises. This phenomenon is useful in determining the minimum value of drive voltage applied to the heater resistors to nucleate ink in the firing chamber. That is, the substrate temperature is monitored as the drive voltage value is increased. When the substrate temperature decreases, the drive voltage measured at this temperature drop is retained on the minimum drive voltage for this particular substrate. The minimum drive voltage may be encoded into the printhead identification circuit for later use.

The circuit 1801 uses this phenomena to detect the sufficiency of ink flow through the thermal inkjet printhead. The sensor RT senses the temperature of the printhead as it prints. Detector circuitry within the circuit then compares a first change in temperature of the printhead at one point in printing with a second change in the temperature of the printhead at another point in the printing. Based on that comparison, the detector circuitry determines the sufficiency of the ink flow through the printhead.

The detector circuitry within circuit 1801 includes a number of elements including a data processor such as a microprocessor 1803. Microprocessor 1803 is also used for control of the printing that pulses the heater resistors such as R1 and R2. Connected to a data port of the microprocessor 1803 is an analog-to-digital (ADC) 1805 which converts an analog signal proportional to the resistance of RT into a digital signal that may be evaluated by the processor. Also connected to the processor 1803 and responsive to its control is a variable resistor $R_V$. Resistor $R_V$ is part of a gain circuit which also includes an operational amplifier 1807, a resistor R3 connected between the inverting input of the amplifier and heater resistor R2, and a transistor Q1 connected to the output of the amplifier. Thermal sense resistor RT is connected to the noninverting input of the amplifier 1807 and also to a current source Ir controlled by a switch S1. Current source Ir produces a voltage across RT which is used to measure its resistance. Switch S1 is responsive to an enable signal film processor 14 When S1 is closed, the detector circuitry operates to measure and compare temperature changes of the printhead.

With this protection circuitry, a gain-adjusted voltage $V_{OUT}$ proportional to the thermally induced resistance of RT is produced according to the equation: $V_{OUT}$=RT*Ir*($R_V$/R3). $D_{OUT}$ an 8-bit digital equivalent of $V_{OUT}$ is produced by the ADC 1805 in response to enable signals from the processor 1803. The value of $D_{OUT}$ can range from 0 to 255 and is directly proportional to the resistance of RT. The gain circuit comprising amplifier 1807, resistors R3 and $R_V$, and transistor Q1 is incorporated into the detector circuitry so that the resistance of RT need not be finely controlled during manufacture. Variations in its resistance can be compensated for by changing the value of the variable resistor $R_V$.

Referring again to FIG. 6, on the cartridge 101', the identification circuit 615, the array circuit 611, and the temperature sense circuit 613 are shown. The electronics circuits 605 includes the controller 617 and head interface circuitry 619 are shown in block diagram form. In the inkjet printer (exclusive of the print cartridge) the microprocessor controller 617, which may be a Motorola MC68000 microprocessor and associated memory, sends digital data to the printhead interface circuitry 619 over digital busses 625–627. Typically, digital bus 625 is an encoded four bit address bus that contains the row addresses for selecting a row of resistor cells in the array circuit 611. Digital busses 626 and 627 are encoded eight bit primitive busses that contain the column addresses and timing information for selecting a particular resistor cell within a particular row of resistor cells. In turn, the digital information carried by the digital busses 625, 626, 627 is converted into analog pulses on drive lines 631 by the printhead interface circuitry 619. Only the address (row) drive lines 631 are shown in FIG. 6. The analog pulses are of sufficient duration and energy to heat the resistor cells in the array circuit 611 and boil the ink.

Also coupled to the address drive lines 631 are corresponding input lines 632, which are in turn coupled to the inputs of the identification circuit 615. An integrated temperature sense circuit 613 is also integrated into the same integrated circuit as the array and identification circuits 611 and 615, in order to supply temperature data to the controller 617. The output of the identification circuit 615 and the temperature sense circuit are multiplexed together, thus sharing a single, existing interconnection pad. The single output containing the identification and temperature data is supplied to the controller 617 through data output line 637.

Figure 19:
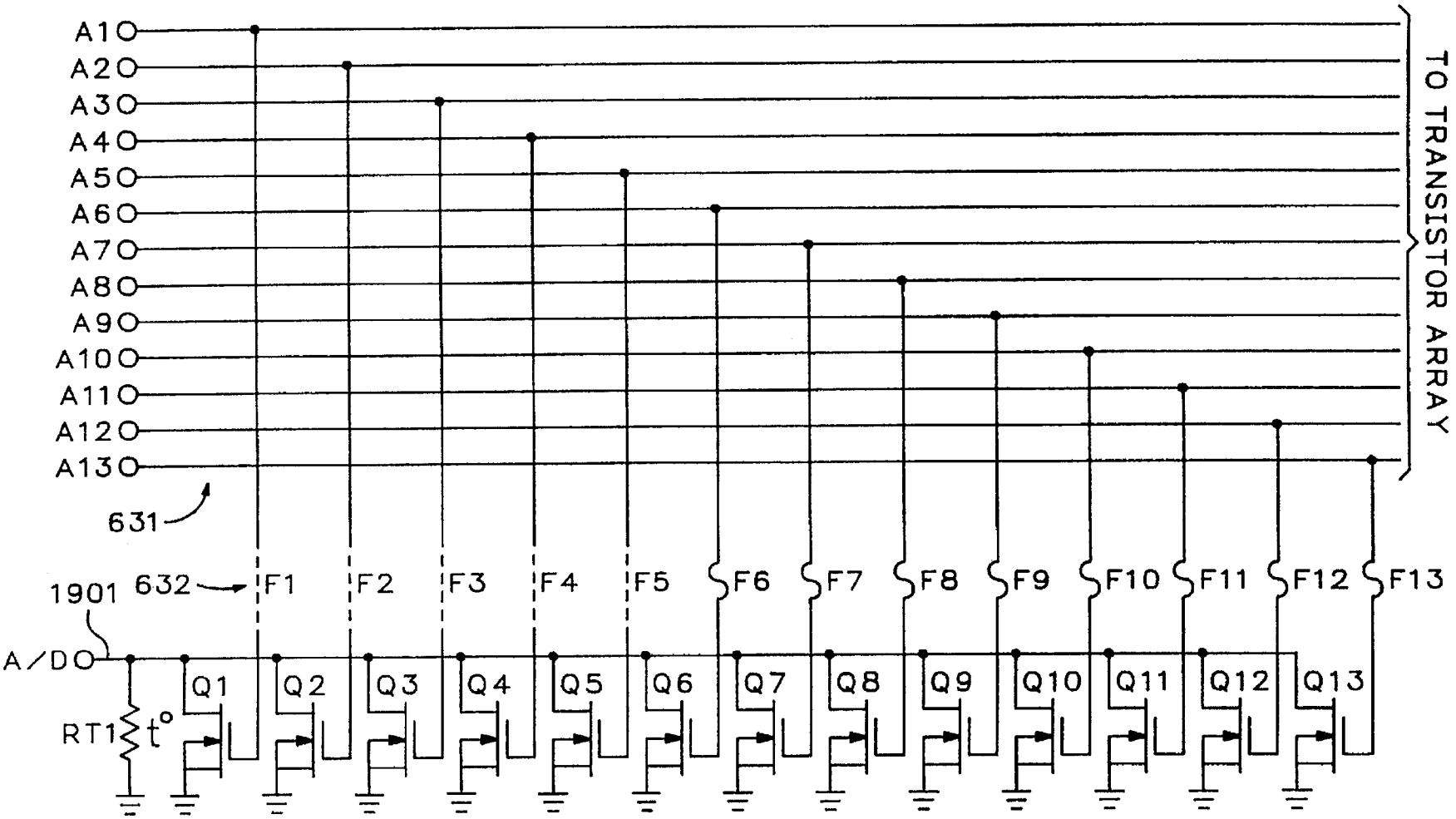
FIG. 19 is a schematic diagram of the identification circuit which may be employed in the present invention.

A schematic of the identification circuit 615 is shown in FIG. 19. The address drive lines 631 are shown including individual drive lines A1 through A13. The identification circuit 615 further includes a plurality of programmable paths corresponding and coupled to each address (row) line 631 through input lines 632. The programmable paths each include the serial combination of a programmable fuse and an active device. In FIG. 19, the programmable fuse is either mask programmable, a fusible link, or other type of fuse in series with the gate of a field effect transistor. Fuses F1–F5 are typically mask programmed at the time the print cartridge 101' is manufactured. Programmable fuses F6–F13 are fabricated out of polysilicon or other suitable materials and are typically programmed by a programming circuit (not shown) after the cartridge is manufactured. The active device is typically a field effect transistor (Q1–Q13). The programmable path in series with the gates of transistors Q1–Q13 are programmed to make a connection to the address lines 631 to establish a digital code. The digital code generated by transistors Q1–Q13 provides information to the inkier printer as to the type of print cartridge that is installed and other information related to manufacturing tolerances and defects. In FIG. 19, fuses F1–F5 are depicted in an undefined (either logic one or logic zero) logic state, and fuses F6–F13 are depicted in an unprogrammed state (either all logic one or logic zero, depending upon the convention chosen). The second end of the programmable paths (in FIG. 19 the second end of the programmable paths is the drain of transistors Q1–Q13) are coupled together at node 1901. Node 1901 forms a single output signal in response to a polling of the address lines 631. Node 1901 is coupled to an output circuit, which is simply a pull-up resistor (not shown in FIG. 19) coupled to a positive power supply in the inkjet printer.

The programming circuit is activated by supplying a logic high signal on its input line. By selecting a particular address line $A_N$, an extra current flows through the corresponding programming transistor sufficient to program (open) the fuse. Fuses coupled to unselected address lines remain unprogrammed (short circuited). It is important to note that, while the input line represents an extra input pin for the printhead, it is not necessary that the input line be grouped with the existing printer connector pads. The extra input line connector pad can be placed anywhere on the printhead.

Referring back to FIG. 19, if a programmable path is programmed to form a connection between an address line $A_N$ and the gate of the corresponding field effect transistor $Q_N$, a polling of the address line turns on the transistor and pulls node 1901 low. Alternatively, if a programmable path is programmed to form an open circuit between an address line and the gate of the corresponding field effect transistor, a polling of the address line has no effect on the turned off transistor, since the gate is pulled low, and node 1901 remains high. The signal on node 1901 is a serial data output corresponding to the data code formed polling the address lines coupled to the programmable paths of the identification circuit 615.

The identification signal output at node 1901 is also coupled to a thermal resistor RT1, which forms a resistor divider with a pull-up resistor (not shown) between $V_{CC}$ and ground. The value of the thermal resistor is set to provide a suitable voltage ratio. A typical example of desirable values for the thermal resistor and pull-up resistor are 422 ohms each. The 422 ohm value is standard for a 1% resistor, but other values can be used for each resistor, and the resistor values need not be the same. For a VCC equal to five volts and resistance values being equal, however, the ratio of resistor values sets a nominal voltage at node 1901 of 2.5 volts. Analog information relating to the printhead temperature and digital information relating to the identification code are multiplexed together in order that an additional interconnect is not needed. The output signal at node 1901 provided analog temperature information within a first voltage range of about two volts at 0° C. to about four volts at 100° C. The same output node provides an output identification signal in response to the polling of the address lines 631 within a second voltage range. Output node 617 falls to about one volt or less when an address line $A_N$ is polled and the corresponding programmable path has been previously programmed to form a connection to the gate of the associated transistor $Q_N$. The one volt signal can therefore be used as a logic zero. If the programmable path has been previously programmed to form an open circuit, the preexisting analog temperature does not change. The two to four volt temperature voltage can therefore be used as a logic one.

The fuses are programmed according to a predetermined pattern. Part of the pattern can be programmed at preassembly (through mask programmable fuses) to identify the print cartridge and part of the pattern can be programmed after the print cartridge is assembled (through integrated current programmable fuses) to provide compensation information to the controller. Programming the fuses includes the step of forming an open-circuit path between an address line and an active device in response to a logic high signal impressed on the selected address line and a current pulse from a programming circuit. A short-circuit path remains coupled to the unselected address lines.

Once the predetermined pattern of short and open circuit paths is programmed into the identification circuit, each row line can be polled to ascertain the identification data. If the primitive connections to the resistor array circuit are disconnected or the primitive voltage pulses are not used, no power is consumed in the resistor array and the address polling pulses can be as long as desired. Otherwise, short address polling pulses are desirably used that are not of sufficient duration to cause significant heating in the resistor array. The polling of the row lines causes a signal current to flow through the programmable paths that are programmed in a first logic state (short circuit) and no current to flow through the programmable paths that are programmed in a second logic state (open circuit). The signal currents of the programmable paths are combined to form a single serial output identification signal.

We claim:

1. A printhead for a thermal inkjet printer comprising:

a substrate having an ink feed aperture disposed in said substrate and extending from a first surface to a second surface of said substrate;

a plurality of heater resistors disposed in a first surface of said substrate and arranged in at least one column, a first number of said heater resistors in said at least one column forming one of a second number of primitive groups of heater resistors, each of said second number of primitive groups coupled to an associated one of said second number of primitive group power sources, said first number of said heater resistors arranged in at least two subgroups of heater resistors, each of said heater resistors disposed apart from a nearest neighboring heater resistor by a predetermined first distance in a direction parallel to the direction of orientation of said at least one column on said substrate, each heater resistor in a first subgroup of said at least two subgroups of heater resistors further having an offset from each neighboring heater resistor in a direction perpendicular to the direction of orientation of said at least one column, a sum of said offsets of each said heater resistor in said first subgroup in said direction perpendicular to the direction of orientation of said at least one column establishes a column width of a size equal to said sum, and each heater resistor in a second of said at least two subgroups of heater resistors has an offset from each neighboring heater resistor in said second subgroup in said direction perpendicular to said direction of orientation of said at least one column and has a sum of offsets less than said size of said column width;

an ink barrier layer disposed on said first surface of said substrate and arranged in association with said plurality of heater resistors whereby at least one wall of an ink firing chamber is created around each said heater resistor, said wall having a constricted opening through which ink is supplied to each ink firing chamber;

a plurality of transistors disposed in said substrate, each transistor electrically coupled at its output to an associated one of said plurality of heater resistors and electrically coupled at its input to one of a plurality of addressing signal lines, said plurality of addressing signal lines equal in number to said first number of heater resistors in said one of said second number of primitive groups; and a flexible circuit coupling said printhead to the thermal inkjet printer and comprising a plurality of interconnect pads of a number fewer than one third the number of heater resistors disposed in said substrate, and a plurality of electrostatic discharge protection devices, each of said plurality of electrostatic discharge protection devices coupling between at least two of said interconnect pads and a ground.

2. A printhead in accordance with claim 1 further comprising an orifice plate, disposed on said ink barrier layer, said orifice plate having one surface forming a second wall of each said ink firing chamber, having a plurality of orifices extending from said one surface to a second surface of said orifice plate, and arranged such that each orifice is aligned with an associated one of said heater resistors.

3. A printhead in accordance with claim 1 wherein said substrate further comprises a plurality of layers including a layer of electrically resistive material and a layer of electrically conductive material in electrical contact with said layer of electrically resistive material except in those predetermined locations corresponding to said plurality of heater resistors.

4. A printhead in accordance with claim 1 further comprising an ink flow detector comprising a temperature sensor disposed in and thermally coupled to said substrate.

5. A printhead in accordance with claim 1 further comprising at least one programmable path coupled to an input of at least one of said plurality of transistors whereby a parameter identification may be stored for said substrate.

6. A printhead in accordance with claim 1 further comprising an extension channel disposed on said first surface of said substrate and fluidically coupled between said ink feed aperture and each said constricted opening in said wall.

7. A method of manufacture of a printhead for a thermal inkjet printer comprising the steps of:

creating an ink feed aperture from a first surface to a second surface of a substrate;

disposing a quantity of heater resistors in a first surface of said substrate and arranging said heater resistors in at least one column, a first number of said heater resistors in said at least one column forming one of a second number of primitive groups of heater resistors;

coupling each of said second number of primitive groups to an associated one of said second number of primitive group power sources;

arranging said first quantity of heater resistors in said one primitive group in at least two subgroups of heater resistors, further comprising the steps of:

disposing each of said heater resistors apart from its nearest neighboring heater resistor by a predetermined first distance in a direction parallel to the direction of orientation of said at least one column, offsetting each heater resistor in a first subgroup of said at least two subgroups of heater resistors further offset from each neighboring heater resistor in a direction perpendicular to the direction of orientation of said at least one column, summing said offsets of each said heater resistor in said first subgroup in said direction perpendicular to the direction of orientation of said at least one column to establish a column width having a size equal to said sum resulting from said summing step, and offsetting each heater resistor in a second of said at least two subgroups of heater resistors from each neighboring heater resistor in said second subgroup in said direction perpendicular to said direction of orientation of said at least one column such that a sum of offsets of said second of said at least two subgroups of heater resistors is less than said size of said column width;

depositing an ink barrier layer on said first surface of said substrate and arranging said ink barrier layer in association with said quantity of heater resistors whereby at least one wall of an ink firing chamber is created around each said heater resistor, said wall having a constricted opening through which ink is supplied to each ink firing chamber;

disposing a plurality of transistors in said substrate, electrically coupling each transistor output to an associated one of said quantity of heater resistors, and electrically coupling each transistor input to one of a plurality of addressing signal lines, said plurality of addressing signal lines equal in number to said first number of heater resistors in said one of said second number of primitive groups;

coupling a flexible circuit from said printhead to the thermal inkjet printer via a plurality of interconnect pads of a number fewer than one-third the number of heater resistors disposed in said substrate; and depositing a plurality of electrostatic discharge protection devices on said flexible substrate, each of said plurality of electrostatic discharge protection devices coupling between at least two of said interconnect pads and a ground.

8. A method in accordance with the method of claim 7 further comprising the steps of disposing an orifice plate on said ink barrier layer to cause one surface of said orifice plate to form a second wall of each said ink firing chamber, and producing a plurality of orifices in said orifice plate which extend from said one surface to a second surface of said orifice plate and which are arranged such that each orifice is aligned with an associated one of said heater resistors.

9. A method in accordance with the method of claim 7 further comprising the step of depositing a plurality of material layers on said substrate, including a layer of electrically resistive material and a layer of electrically conductive material in electrical contact with said layer of electrically resistive material except in those predetermined locations corresponding to said quantity of heater resistors.

10. A method in accordance with the method of claim 7 further comprising the step of depositing an ink flow detector comprising a temperature sensor in and thermally coupled to said substrate.

11. A method in accordance with the method of claim 7 further comprising the step of coupling at least one programmable path to an input of at least one of said plurality of transistors whereby a parameter identification may be stored for said substrate.

12. A method in accordance with the method of claim 7 further comprising the step of creating an extension channel on said first surface of said substrate and compiling said extension channel from said ink feed aperture to each said constricted opening in said wall, whereby ink is fluidically coupled to each said constricted opening.

13. A printhead for an inkjet printer which employs heater resistors to expel ink, the printhead comprising:

a substrate having a first surface;

a plurality of heater resistors disposed in said first surface of said substrate and arranged in at least one column, a first number of said heater resistors in said at least one column forming one of a second number of groups of heater resistors, said first number of said heater resistors arranged in at least two subgroups of heater resistors, each of said heater resistors disposed apart from a nearest neighboring heater resistor by a predetermined first distance in a direction parallel to the direction of orientation of said at least one column on said substrate, each heater resistor in a first subgroup of said at least two subgroups of heater resistors further having an offset from each neighboring heater resistor in a direction perpendicular to the direction of orientation of said at least one column, a sum of said offsets of each said heater resistor in said first subgroup in said direction perpendicular to the direction of orientation of said at least one column establishes a column width of a size equal to said sum, and each heater resistor in a second of at least two subgroups of heater resistors has an offset from each neighboring heater resistor in said second subgroup in said direction perpendicular to said direction of orientation of said at least one column and has a sum of offsets less than said size of said column width; and a flexible circuit coupling said printhead to the inkjet printer and comprising a plurality of interconnect pads of a number fewer than one third the number of heater resistors disposed in said substrate, and a plurality of electrostatic discharge protection devices, each of said plurality of electrostatic discharge protection devices coupling between at least two of said interconnect pads and a ground.

14. A method of manufacturing an inkjet printhead employing heater resistors to expel ink, comprising the steps of:

disposing a quantity of heater resistors in a first surface of a substrate;

arranging said heater resistors in at least one column, a first number of said heater resistors in said at least one column forming one of a second number of primitive groups of heater resistors;

arranging said first quantity of heater resistors in said one primitive group in at least two subgroups of heater resistors, further comprising the steps of:

disposing each of said heater resistors apart from its nearest neighboring heater resistor by a predetermined first distance in a direction parallel to the direction of orientation of said at least one column, offsetting each heater resistor in a first subgroup of said at least two subgroups of heater resistors further offset from each neighboring heater resistor in a direction perpendicular to the direction of orientation of said at least one column, summing said offsets of each said heater resistor in said first subgroup in said direction perpendicular to the direction of orientation of said at least one column to establish a column width having a size equal to said sum resulting from said summing step, and offsetting each heater resistor in a second of said at least two subgroups of heater resistors from each neighboring heater resistor in said second subgroup in said direction perpendicular to said direction of orientation of said at least one column such that a sum of offsets of said second of said at least two subgroups of heater resistors is less than said size of said column width;

coupling a flexible circuit from said printhead to the inkjet printer via a plurality of interconnect pads of a number fewer than one third the number of heater resistors disposed in said substrate; and depositing a plurality of electrostatic discharge protection devices on said flexible substrate, each of said plurality of electrostatic discharge protection devices coupling between at least two of said interconnect pads and a ground.

* * * * *